US008099880B2

(12) United States Patent
Brewer et al.

(10) Patent No.: US 8,099,880 B2
(45) Date of Patent: Jan. 24, 2012

(54) ATHLETIC SHOE WITH CUSHION STRUCTURES

(75) Inventors: Chris Brewer, Baltimore, MD (US); Derek Campbell, Columbia, MD (US); Ryan Drew, Lutherville, MD (US); Kevin Fisher, Baltimore, MD (US); Jared Goldman, Lutherville, MD (US); Mark Kokavec, Ellicott City, MD (US)

(73) Assignee: Under Armour, Inc., Baltimore, MD (US)

( * ) Notice: Subject to any disclaimer, the term of this patent is extended or adjusted under 35 U.S.C. 154(b) by 548 days.

(21) Appl. No.: 12/348,852

(22) Filed: Jan. 5, 2009

(65) Prior Publication Data

US 2010/0170106 A1 Jul. 8, 2010

(51) Int. Cl.
*A43B 13/12* (2006.01)

(52) U.S. Cl. ..... 36/30 R; 36/25 R; 36/35 R

(58) Field of Classification Search ..... 36/30 R, 36/28, 31, 103, 25 R, 35 R
See application file for complete search history.

(56) References Cited

U.S. PATENT DOCUMENTS 3,805,417 A 4/1974 Lobmeier et al.
4,597,196 A * 7/1986 Brown ..... 36/44
4,776,109 A 10/1988 Sacre
4,910,886 A 3/1990 Sullivan et al.
4,928,404 A 5/1990 Scheuermann
4,934,072 A 6/1990 Fredericksen et al.
4,984,376 A 1/1991 Walter et al.
5,247,742 A 9/1993 Kilgore et al.
5,319,866 A 6/1994 Foley et al.
5,325,611 A 7/1994 Dyer et al.
5,363,570 A * 11/1994 Allen et al. ..... 36/28
5,493,792 A 2/1996 Bates et al.
5,575,089 A * 11/1996 Giese et al. ..... 36/30 R
5,653,046 A 8/1997 Lawlor
5,667,895 A 9/1997 Jenkner
5,709,954 A 1/1998 Lyden et al.
5,718,063 A * 2/1998 Yamashita et al. ..... 36/28
5,786,057 A 7/1998 Lyden et al.
5,843,268 A 12/1998 Lyden et al.
5,901,467 A * 5/1999 Peterson et al. ..... 36/29
5,909,948 A 6/1999 Ellis, III
5,921,004 A 7/1999 Lyden
5,947,918 A 9/1999 Jones et al.
5,956,869 A 9/1999 Kim
5,974,695 A 11/1999 Slepian et al.
5,979,083 A 11/1999 Robinson et al.
6,003,250 A 12/1999 Cheong
6,108,943 A 8/2000 Hudson et al.

(Continued)

OTHER PUBLICATIONS

U.S. Appl. No. 12/404,098, filed Mar. 13, 2009, Campbell, et al.

*Primary Examiner* — Ted Kavanaugh
(74) *Attorney, Agent, or Firm* — Oblon, Spivak, McClelland, Maier & Neustadt, L.L.P.

(57) ABSTRACT

A footwear lower is presented which provides cushion support and lateral stability in a lightweight construction. The lower may include a primary midsole, cushion elements, a rear lower midsole, a directional cradle, and an outsole. The cushions may be located in the between the directional cradle and the rear lower midsole. Various embodiments of cushions are presented and may be consistent with specific types of shoes such as running trainers, trail shoes, general fitness footwear, or basketball shoes. The lower may be consistent with approaches to remediate a wearer's pronation or supination.

25 Claims, 29 Drawing Sheets

U.S. PATENT DOCUMENTS 6,115,944 A * 9/2000 Lain ..... 36/35 R
6,115,945 A 9/2000 Ellis, III
6,154,983 A 12/2000 Austin et al.
6,158,149 A 12/2000 Rudy
6,199,302 B1 3/2001 Kayano
6,205,681 B1 3/2001 Kita
6,219,939 B1 4/2001 Kita et al.
6,289,608 B1 9/2001 Kita et al.
6,311,414 B1 11/2001 Kita
6,314,664 B1 11/2001 Kita et al.
6,321,468 B1 11/2001 DeGrand et al.
6,338,206 B1 1/2002 Kita
6,354,020 B1 * 3/2002 Kimball et al. ..... 36/29
6,381,875 B2 5/2002 Singer et al.
6,438,870 B2 8/2002 Nasako et al.
6,497,057 B1 12/2002 Lee et al.
6,516,539 B2 2/2003 Nishiwaki et al.
6,584,706 B1 7/2003 Ellis, III
6,598,320 B2 7/2003 Turner et al.
6,685,011 B2 2/2004 Nishiwaki et al.
6,694,642 B2 2/2004 Turner
6,708,426 B2 3/2004 Erickson et al.
6,711,834 B1 3/2004 Kita
6,722,058 B2 4/2004 Lucas et al.
6,874,257 B2 4/2005 Erickson et al.
6,920,705 B2 7/2005 Lucas et al.
6,983,555 B2 1/2006 Lacorazza et al.
6,990,755 B2 1/2006 Hatfield et al.
7,073,275 B2 7/2006 Hay
7,080,467 B2 7/2006 Marvin et al.
7,082,702 B2 8/2006 Cretinon
7,159,259 B2 1/2007 Chen
7,171,767 B2 2/2007 Hatfield et al.
7,178,267 B2 2/2007 Skaja et al.
7,243,445 B2 * 7/2007 Manz et al. ..... 36/103
7,278,226 B2 10/2007 Holden et al.
7,334,351 B2 2/2008 Hann
2003/0208926 A1 11/2003 Ellis, III
2006/0032087 A1 2/2006 Lacorazza et al.
2006/0277799 A1 12/2006 Lebo
2007/0017122 A1 * 1/2007 Feller et al. ..... 36/35 R
2007/0124960 A1 6/2007 Friedman
2010/0031530 A1 * 2/2010 Abshire ..... 36/28

* cited by examiner

ATHLETIC SHOE WITH CUSHION STRUCTURES

BACKGROUND

1. Field of the Invention

This invention relates to footwear having an upper and a lower, more specifically to a cushion structure integrated as part of the lower.

2. Description of the Related Art

The modern shoe is a combination of various components which all have a critical function in the performance of the shoe. Each component must work closely as a system for the support, comfort, and protection of the user's foot. There are specialized shoes designed for athletes in very different activities from: road running, hiking, general fitness, and basketball. Each of these shoes are designed to provide a special blend of performance related to traction, support, comfort, and protection. Shoes are also designed for the physical characteristics of the wearer such as the user's weight, shoe size and gait (i.e. over pronation, supination, flat-footed). Specifically, the weight, cushioning, lateral stability characteristics of a shoe can be a strong determinant of performance because they may directly impact an athlete's speed, endurance, and sure-footing.

There has been many attempts to create cushion devices in the shoe to improve shock absorption yet these efforts have produced insufficient lateral stability or unnecessarily heavy shoes that are inadequate for serious athletes and active people.

Although foregoing efforts have met with varying degrees of success, there remains an unresolved need for a lower for athletic footwear with improved shock absorption, lateral stability, and low weight. The problem is that previous shoe technology does not provide the level of shock and shear force absorption required by the wearer for demanding applications without an unacceptable thicker sole, greater weight, or loss of lateral stability. There are additional issues to consider such as changes to the bending and twisting characteristics of the shoe as shock absorbing materials are used that might compromise measures to control pronation or other undesirable walking or running characteristics of the wearer.

SUMMARY

One aspect of the present invention is to address and resolve the above limitations with conventional footwear wherein the integration of shock absorption elements unsatisfactorily compromises lateral stability, increases the weight, or increases the thickness of the midsole.

In a first aspect, the present invention may include a lower shoe adapted to be attached to an upper. The lower may include a primary midsole, a directional cradle, a set of three cushion elements, a rear lower midsole, and a rear outsole. The primary midsole may be sized to be the full length of the wearer's foot. The cradle may be attached to the primary midsole in a location corresponding to a wearer's heel. The set of cushion elements may be configured to be attached at separate mounting surfaces located on the bottom of the directional cradle. The bottom sides of the cushion elements may be attached to three separate mounting surfaces on the rear lower midsole. The outsole having one or more pieces, may be adapted to be attached to bottoms of the rear lower midsole, directional cradle and primary midsole. The components may be attached together using a cement glue or a general epoxy adhesive.

In another aspect, the lower may include a full-length primary midsole, a directional cradle, a first cushion, a second cushion, a rear lower midsole, and a one-piece outsole. The directional cradle may be attached to the rear bottom of the primary midsole. The first and second cushions may be attached to the bottom of the cradle. The first cushion may be larger than the second cushion. The first cushion may be attached to a bottom mounting surface on the cradle corresponding to both the inner and rear sections of the shoe. The second cushion may be attached to a bottom mounting surface on the cradle corresponding to the outer section of the shoe. The top of the rear lower midsole may have a first mounting surface and a second mounting surface where the first and second cushions may be attached respectively. The outsole may be attached only to the rear lower midsole and the primary midsole. The components may be attached together using a cement glue or a general epoxy adhesive.

In yet a third aspect, the lower may include a full-length primary midsole, a directional cradle, a first cushion, a second cushion, a third cushion, an outer rear lower midsole, an inner rear lower midsole, and an outsole. The directional cradle may be attached to the primary midsole. The first cushion may be attached to the bottom side of the cradle and near the inner lateral side of the shoe. The second and third cushions may be attached to the bottom side of the cradle and near the outer lateral side of the shoe. The inner rear lower midsole may be attached to the bottom of the first cushion. The outer rear lower midsole may be attached to the bottoms of the second and third cushions. The outsole may be attached to the primary midsole, the cradle, the inner rear lower midsole, and the outer rear lower midsole. The components may be attached using a cement glue or a general epoxy adhesive.

In the next aspect, the lower may include a full-length primary midsole, a directional cradle, a single cushion, a rear lower midsole, and a two-piece outsole. The directional cradle may be attached to the rear bottom of the primary midsole. The cushion may be attached to the bottom of the cradle and the primary midsole. The top of the rear lower midsole may have a mounting surface where the cushion may be attached. The pieces of the outsole may be attached to the rear lower midsole, the cradle, and the primary midsole. The components may be attached together using a cement glue or a general epoxy adhesive.

In yet another aspect, there may be a multi-piece outsole or a multi-piece primary midsole included as part of the lower.

As should be apparent, the invention can provide a number of advantageous features and benefits. It is to be understood that, in practicing the invention, an embodiment can be constructed to include one or more features or benefits of embodiments disclosed herein, but not others. Accordingly, it is to be understood that the preferred embodiments discussed herein are provided as examples and are not to be construed as limiting, particularly since embodiments can be formed to practice the invention that do not include each of the features of the disclosed examples.

BRIEF DESCRIPTION OF THE DRAWINGS

The invention will be better understood from reading the description which follows and from examining the accompanying figures. These are provided solely as non-limiting examples of the invention. In the drawings.

DETAILED DESCRIPTION OF THE PREFERRED EMBODIMENTS

Figure 1:
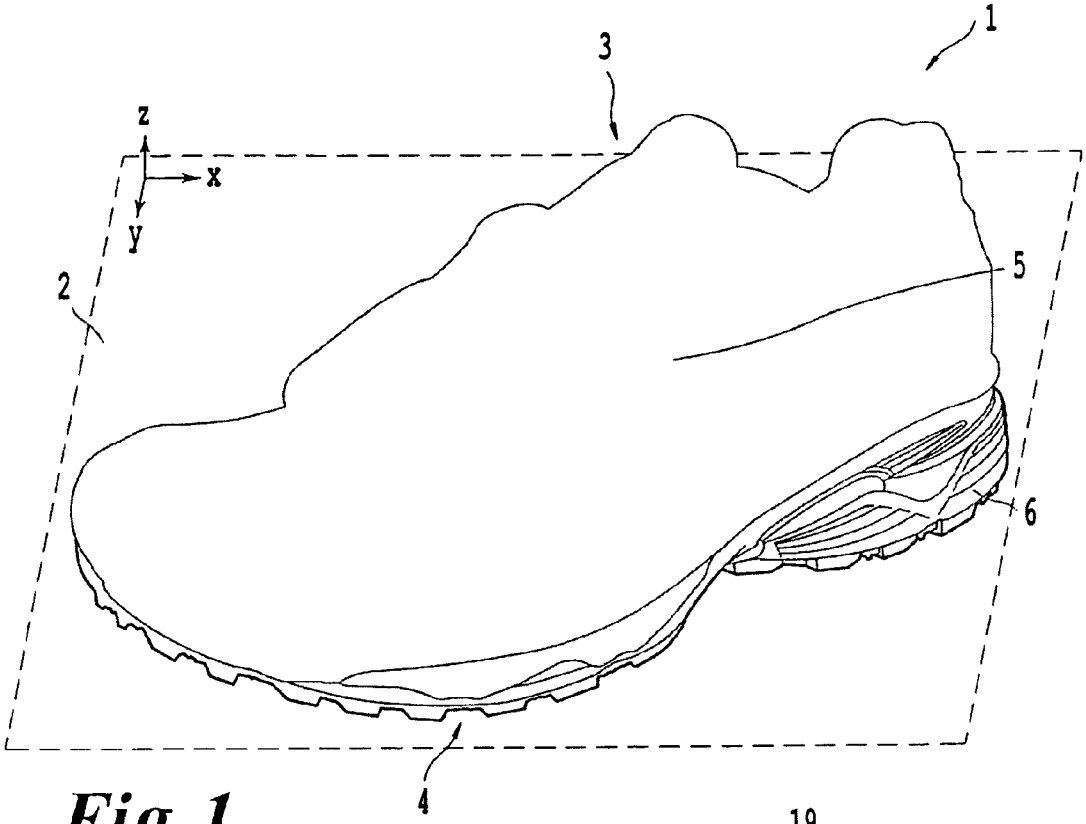
FIG. 1 illustrates an upper and a lower of a shoe according to an embodiment of the present invention.

Reference will now be made in detail to the present preferred embodiments of the invention, examples of which are illustrated in the accompanying drawings. Wherever possible, the same reference characters will be used throughout the drawings to refer to the same or like parts.

Figure 2:
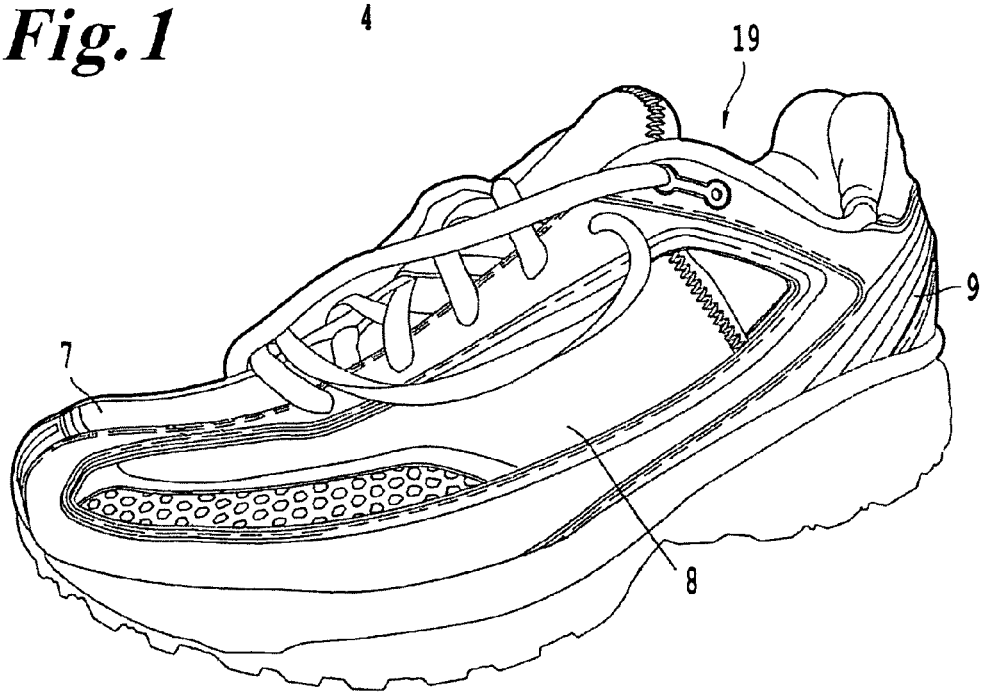
FIG. 2 illustrates a toe box, a vamp, and a counter according to an embodiment of the present invention.

FIG. 1 illustrates a left athletic shoe 1 resting on the ground 2 consistent with the present invention. A three dimensional axis shows X and Y directions as horizontal directions with respect to the ground and Z as a vertical direction. The shoe 1 has a top 3 and bottom 4. The shoe 1 includes both an upper 5 and a lower 6. FIG. 2 illustrates various embodiments of the upper including a toe box 7, a vamp 8, and a counter 9. The toe box 7 demarcates the area overlying the wearer's toes. The toe box may be made deeper to provide more room for the wearer's toes to move. The vamp 8 may be the shoe component covering the arch of the shoe and serves as the bridge between the toe box 7 and an opening 19 of the shoe where the wearer's foot 18 may be inserted or withdrawn from the shoe. A snug vamp 8 may be preferable to prevent the wearer's heel from slipping during use. The counter 9 may be the back part of the upper 5 which wraps around the heel of the wearer's foot 18. Other embodiments of an upper may have no counter or toe box.

The upper 5 includes an opening 19 through which a wearer's foot 18 may be inserted into a shoe. The opening 19 may be loosened or tightened upon a portion of the wearer's foot using a variety of closures including laces, buckles, hook-and-loop fasteners, and other means. An upper consistent with this disclosure may also be an assembly that merely serves the purpose of attaching the lower to the sole of the foot for a desired time period. The upper 5 may be made of various materials to optimize shoe performance in certain conditions such as leather, canvas, or synthetic materials such as plastic, artificial suede, synthetic leather, nylon weave, nylon mesh, or the like. The components of the upper 5 may be attached using stitching, or an adhesive, such as a cement glue.

The lower 6 may include a footbed, a midsole, and an outsole. In one embodiment the footbed may include a full length insole made of a structural member, such as cardboard, to provide stability in a construction that is known as "board lasting." The softer the insole, the less torsional stability (lengthwise twist) will be exhibited by the shoe. The firmer the insole (cardboard) the more structure and stability will be exhibited by the shoe. Pronators, supinators or people whose feet collapse excessively may typically select shoes with a cardboard last to provide extra stability.

Another embodiment, called "slip lasting" replaces the structural member with a cloth structure to maximize flexibility for the shoe to twist. A further embodiment provides may be a "combination last" where the front of the shoe may be slip lasted and the back may be board lasted. Another embodiment may be a construction without the cloth structure as part of the footbed and the upper may be attached to the midsole by sewing or adhesive. The footbed may be the structural foundation of the shoe wherein the upper may be attached to the footbed with the wearer's foot between a portion of the upper and the insole. A removable sock liner may be used to provide an interface between the wearer's foot and the top of the footbed structure.

The outsole may be attached to the footbed via the midsole. The outsole provides the contact surface between the shoe and the ground. The outsole may contain carbon rubber (BRS 1000), solid rubber (blend of synthetic and natural rubber), durable rubber compound (blend of synthetic rubber with other additives), blown rubber (synthetic rubber compound with tiny air pockets), gum rubber (natural and synthetic rubber blend with a natural tan color), and the like. Carbon rubber may be harder and more durability than blown rubber; however, the later may provide additional cushioning and "road feel." An assortment of other materials and pigments may also be used to produce different textures and colors on the outsole.

Figure 3:
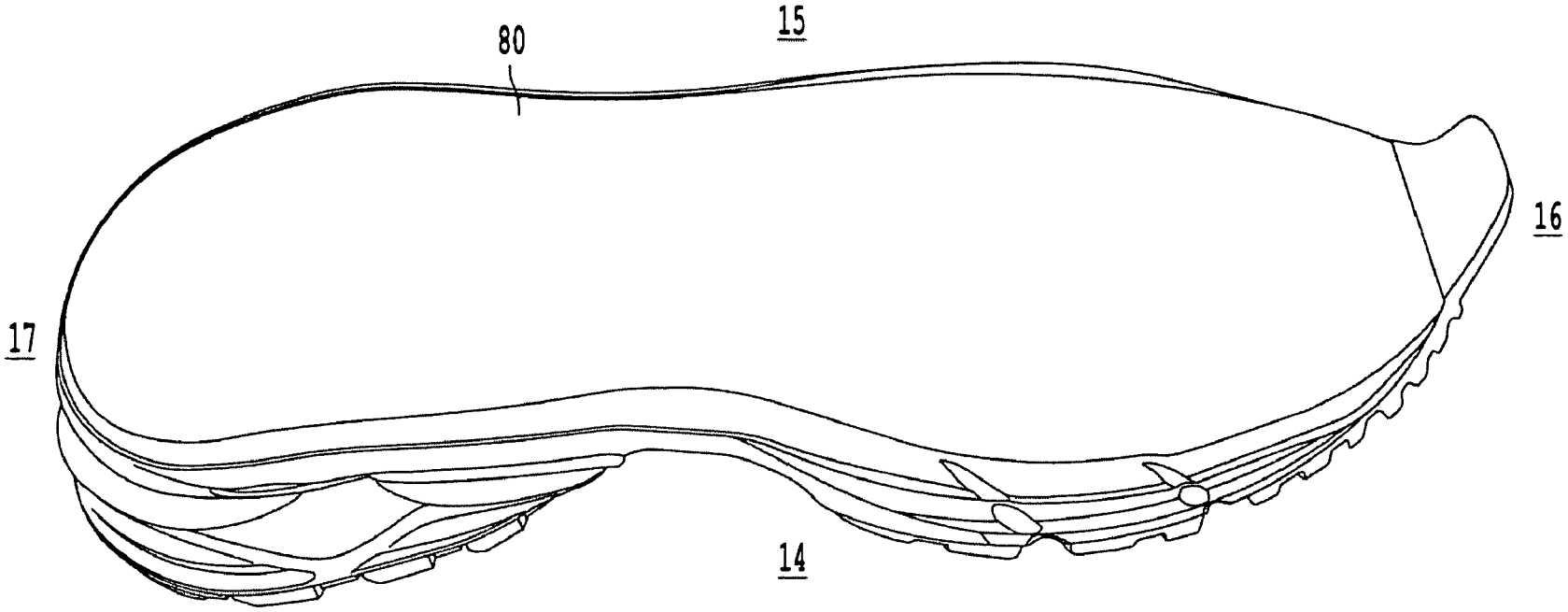
FIG. 3 illustrates a top inner view of the lower of a shoe according to the first embodiment.
Figure 4:
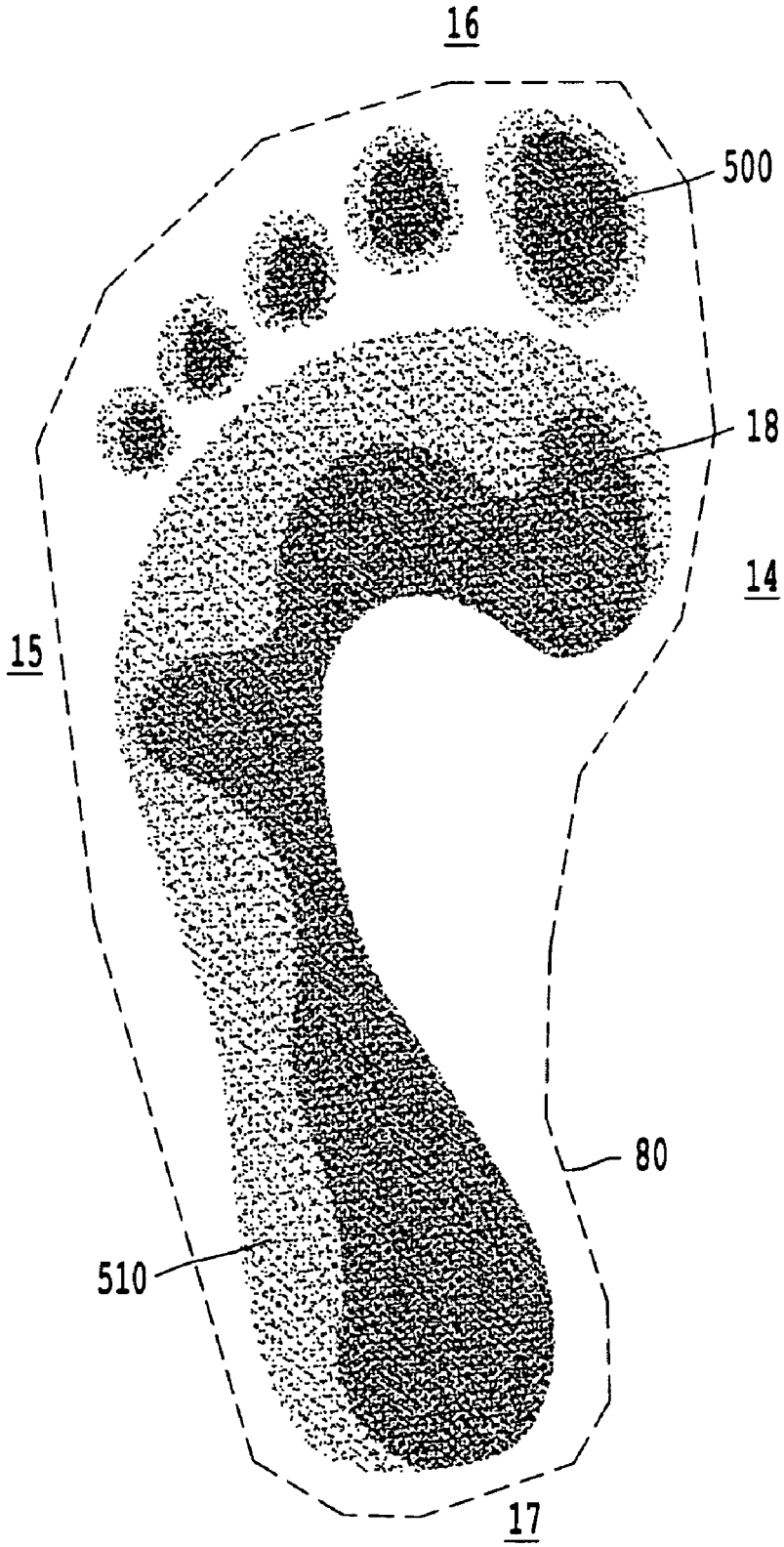
FIG. 4 illustrates a top inner view of shoe directions relative to a left foot disposed within a shoe according to an embodiment of the present invention.
Figure 6:
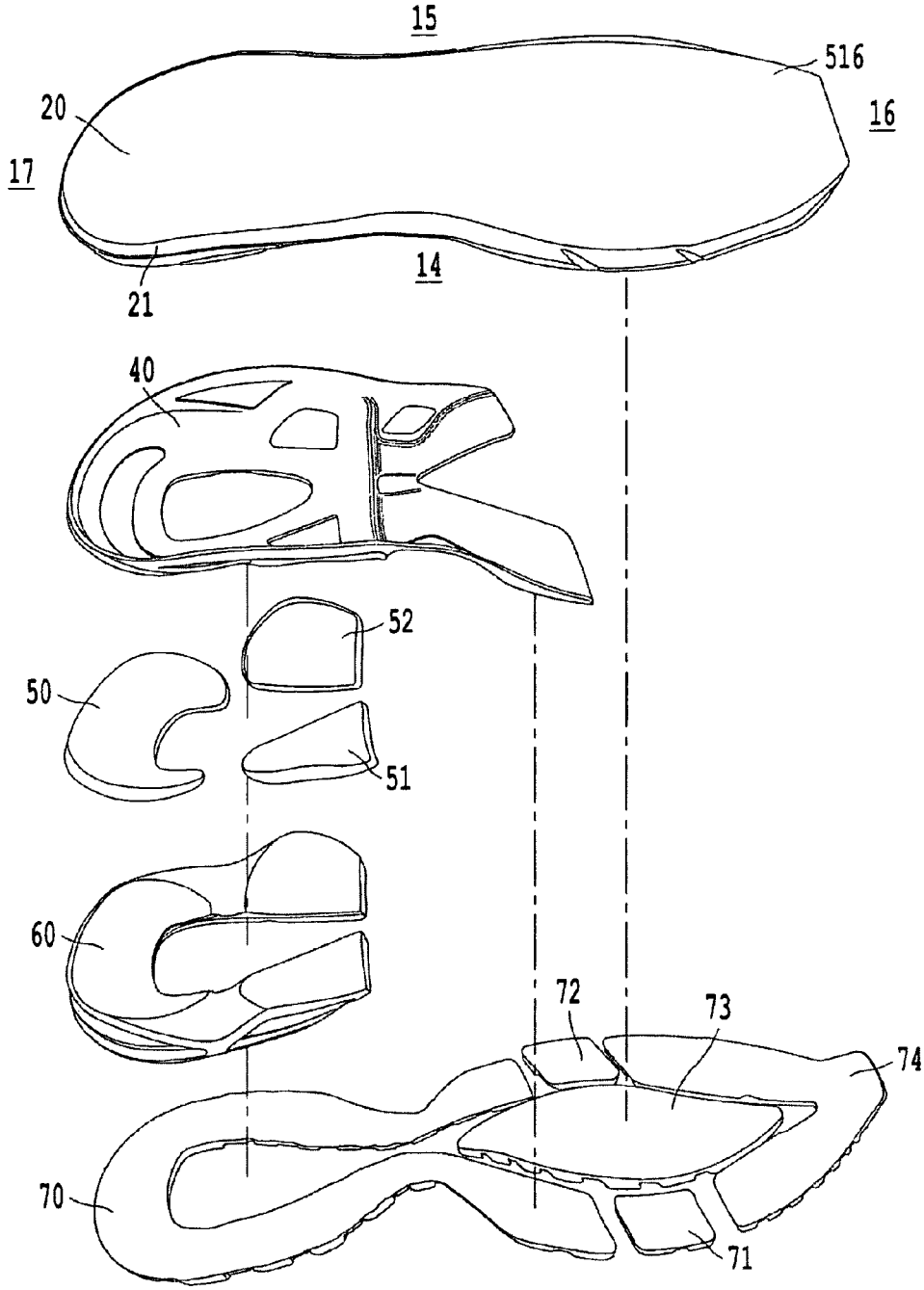
FIG. 6 illustrates an exploded lower of a shoe according to a top inner view of a first embodiment of the present invention.

FIG. 3 shows a lower 80 consistent with the first embodiment of the present invention. The lower 80 may be better understood by FIG. 4 which illustrates shoe directions relative to the wearer's left foot 18: front 16, inner lateral (inner) 14, outer lateral (outer) 15, and back (rear) 17. The lower 80 may comprise a primary midsole 20, a directional cradle 40, a rear cushion 50, a front inner cushion 51, a front outer cushion 52, a rear lower midsole 60, a rear outsole 70, an outer lateral outsole 72, an inner lateral outsole 71, and a forefoot outsole 74. FIG. 6 illustrates the lower 80 in an exploded view.

Figure 5:
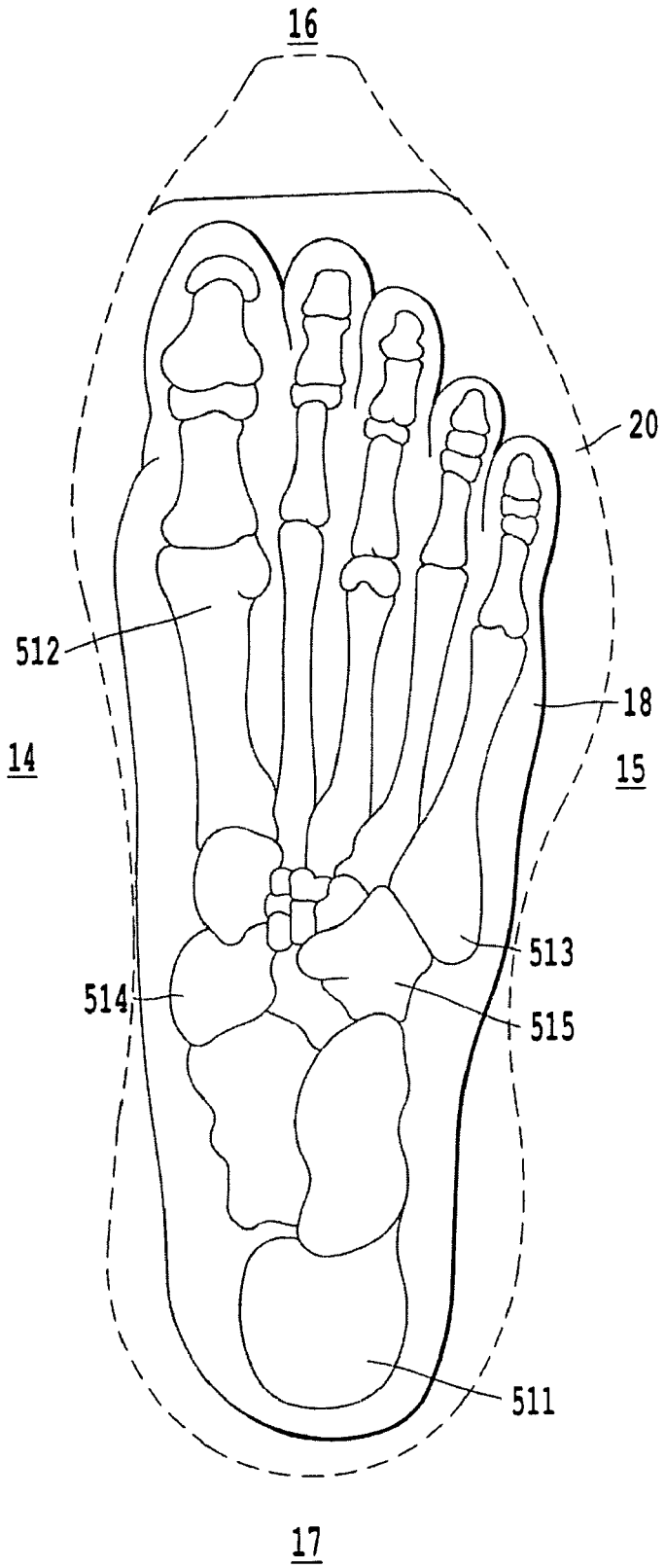
FIG. 5 illustrates a bottom view of a primary midsole according to an embodiment of the present invention with the foot and a set of associated foot bones superimposed on the primary midsole.
Figure 7:
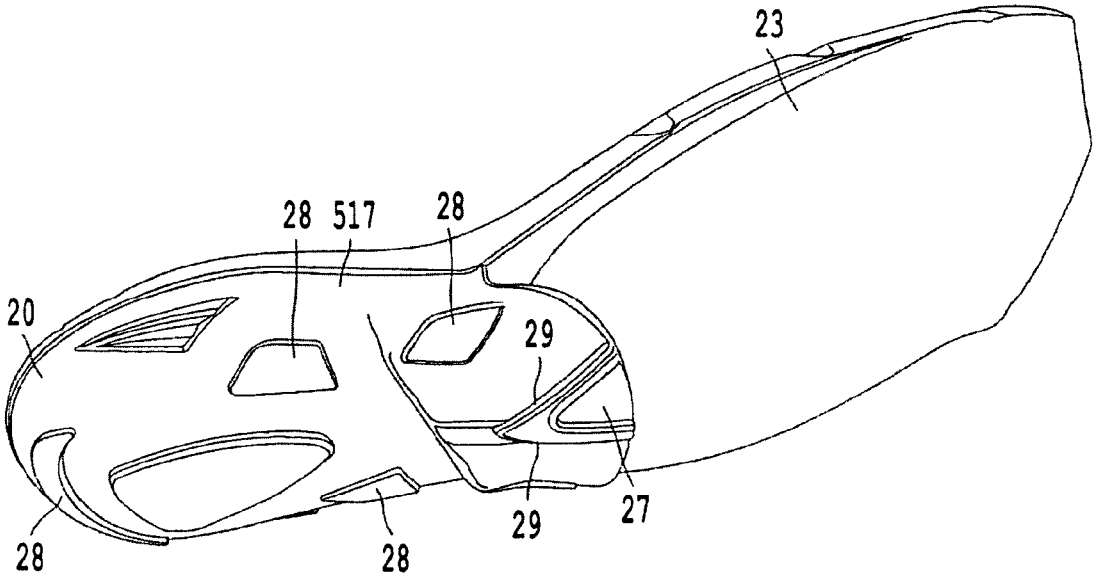
FIG. 7 illustrates a bottom inner view of the primary midsole according to the first embodiment.

FIG. 7 illustrates a periphery edge 21 as part of the primary midsole 20 that may be adapted to be curved up around the bottom of the heel 510 of the foot 18. The primary midsole may also have built-in arch support. The primary midsole may include a top surface 516 and a bottom surface 517. The primary midsole 20 may be a full-length midsole where the top surface 516 may be configured to directly support the entire bottom (plantar) surface of the foot 18. The top surface 516 may also include various surface locations configured to support foot bones when the foot 18 is inserted within the shoe 1. FIG. 5 shows the foot bones superimposed on a primary midsole 20 consistent with the present invention where a first location 511 on the top surface 516 may be configured to support the calcaneous bone of the foot, a second location 514 may be configured to support the namcular bone, a third location 515 may be configured to support the cuboid. The primary midsole may be also configured to support other foot bones.

The primary midsole 20 may include one or more directional channels in the top surface 516 to encourage the shoe to flex in an advantageous direction. The directional channels may be parallel, substantially parallel, or of the same or varying depths.

Further, the top surface 516 of the primary midsole 20 may be gradually sloped upward when traveling from the front 16 to the back 17 to enable more shoe structure to be integrated beneath a wearer's heel 510. This additional structure may offer different moduli of elasticity, energy absorption, deformation, and wear characteristics than the primary midsole 20.

FIG. 7 shows the bottom surface 517 of the primary midsole 20. The bottom surface 517 may be a generally convex surface and may include various locations to help interface with other components of the shoe 1 such as: a sunken surface 23, a raised area 24, a raised surface 25, an interface surface 26, a raised area 27, raised surfaces 28, and a set of raised edges 29. The primary midsole 20 may be made from ethylene vinyl acetate (EVA), polyurethane, compounds having EVA and rubber, polyether urethane, polyester urethane, ethylenevinylacetate/-polyethylene copolymer, polyester elastomer, nitrile rubber, ethylene propylene, polybutadiene, styrene-butadiene (SBR), carboxylated nitrile rubber (XNBR), and the like.

Figure 8:
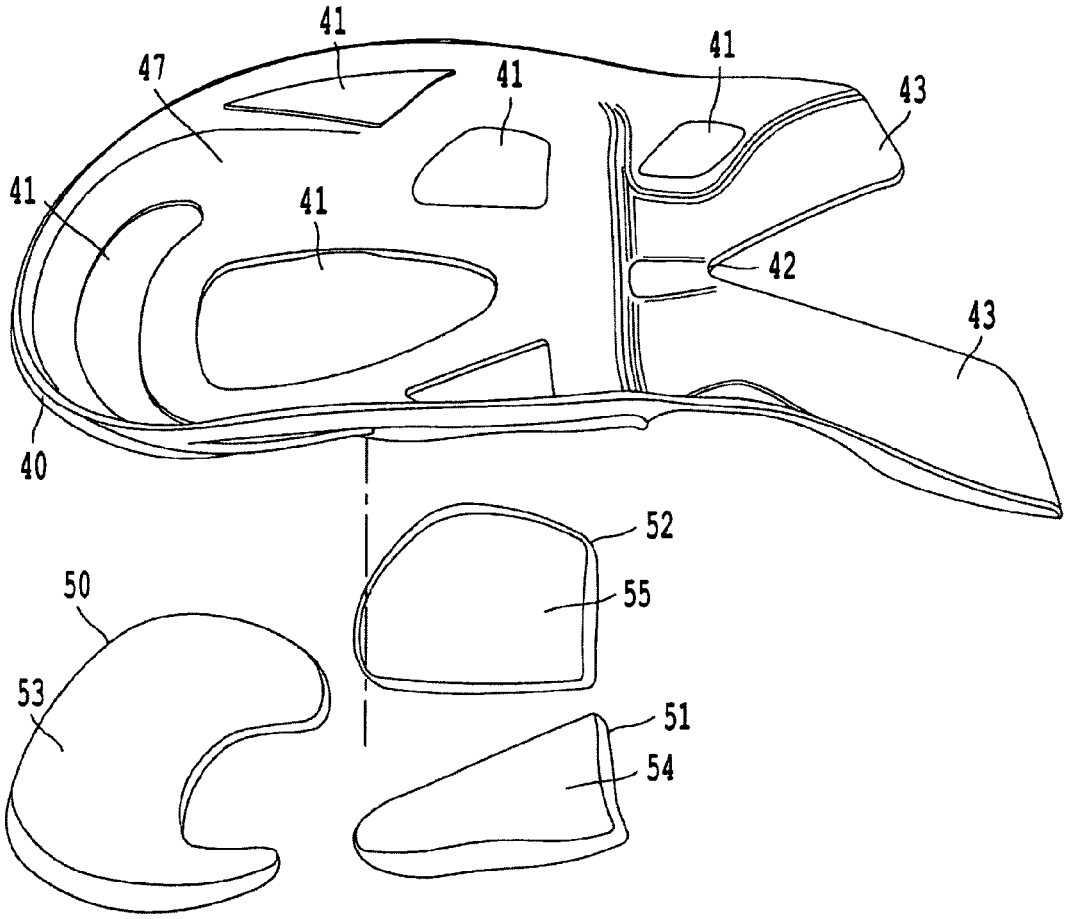
FIG. 8 illustrates a top inner view of a directional cradle and a cushion interface of a shoe according to the first embodiment.

A directional cradle 40 consistent with this embodiment is shown in FIG. 8. The directional cradle may contribute rigidity not provided by the primary midsole 20 and may also encourage shoe flexure in one or more directions to discourage over pronation and over supination, or may provide other advantageous characteristics. The cradle 40 may be made of polyurethane material, tevax, thermoplastic urethane, or the like. The modulus of elasticity of the cradle may be greater than that of the primary midsole 20. The cradle 40 may have a plurality of openings 41 to interface with a set of corresponding raised areas 28 on the bottom surface of the primary midsole 20. A top surface 47 of the cradle 40 may be generally concave and may be attached to an interface surface 26 of the primary midsole 20 via a cement glue, an epoxy-based adhesive, or the like. In other embodiments the cradle 40 may be optional.

The cradle 40 also may have surfaces 43 to interface with the bottom of the primary midsole 20. The rear 17 portion of the cradle 40 may be contoured to support a wearer's heel 510. The front portion 16 of the cradle 40 may be angularly shaped and contoured to support the arch of a foot 18 and may interface with the midsole and outsole. The cradle 40 and primary midsole 20 may be attached together via cement glue, epoxy-based adhesive, or the like. The cradle 40 also includes a set of edges 42 configured to interface with the primary midsole 20 at a set of edges 29 as shown in FIG. 7. The cradle 40 may be attached to the primary midsole 20 via cement glue, epoxy-based adhesive, or the like.

FIG. 8 shows a set of cushions 50, 51, and 52 in this embodiment. The cushions 50, 51, and 52 may be made of the same material or different materials. Other embodiments may include only one or two of these cushions. The cushions may have opposing sides that are parallel or substantially parallel. These cushions may be manufactured using an injection molding process or in sheets to be cut or stamped to the desired final shapes. The shape may be designed to easily contact an interface surface on another footwear component and/or to allow optimal expansion to meet the cushioning objectives of the footwear. The shape of the cushions may be curvilinear. These cushions may be attached to other components using adhesive and/or attached via an interference fit. In the case when the top surface of the cushions 50, 51, 52 are attached to either the cradle 40 or the primary midsole 20, the top surfaces 53, 54, 55 of the cushions may be disposed to have a concave surface to conform with the bottom surface of the primary midsole or the cradle.

Figure 9:
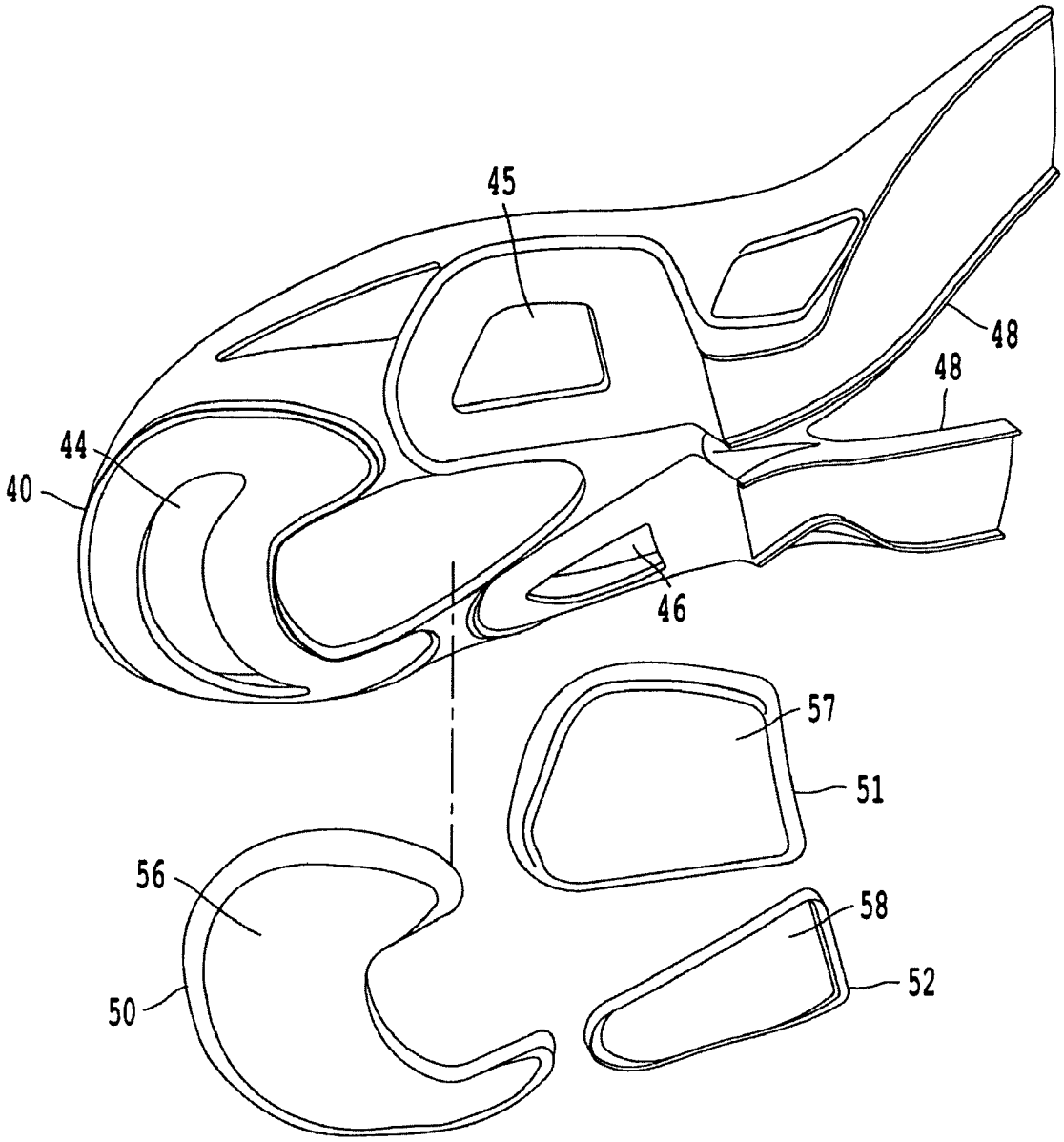
FIG. 9 illustrates a bottom inner view of the directional cradle and the cushion interface according to the first embodiment.

The top surface 53 of the rear cushion 50 interfaces respectively with a shallow depression 44 on the cradle 40 as shown in FIG. 9. The top surface 54 of the front inner cushion 51 interfaces respectively with a shallow depression 45 on the cradle 40. The top surface 55 of the front outer cushion 52 interfaces respectively with a shallow depression 46 on the cradle 40. All the cushions 50, 51, and 52 may be attached to the cradle 40 via cement glue, epoxy-based adhesive, or the like. The cushions 50, 51, and 52 may be made of polymer gel, polyurethane gel, silicone rubber, thermoplastic rubber, or polyurethane foam, or the like.

Figure 10:
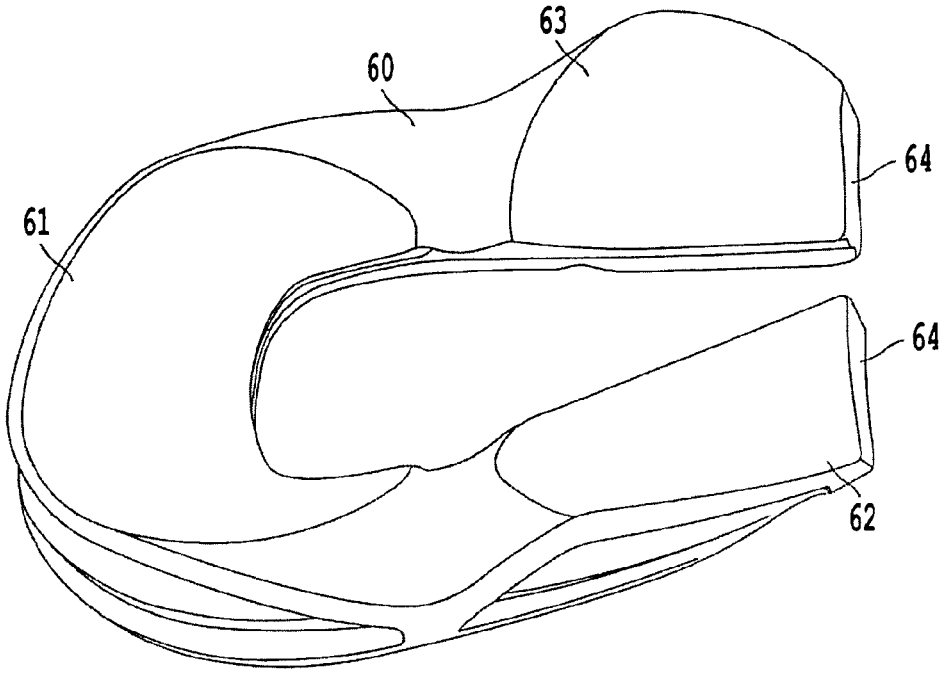
FIG. 10 illustrates a top inner view of a rear lower midsole according to the first embodiment.
Figure 11:
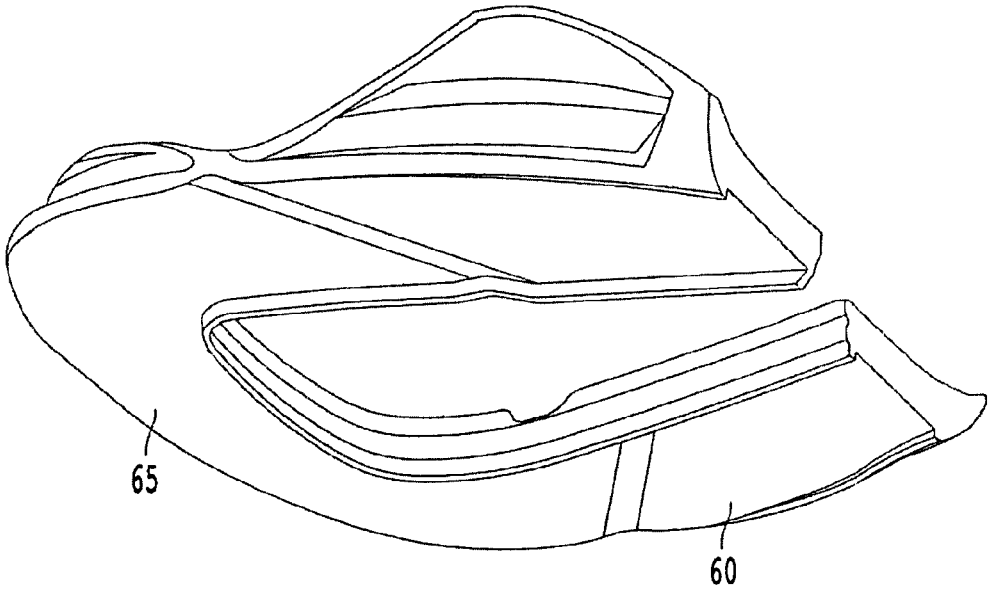
FIG. 11 illustrates a bottom inner view of the rear lower midsole according to the first embodiment.
Figure 12A:
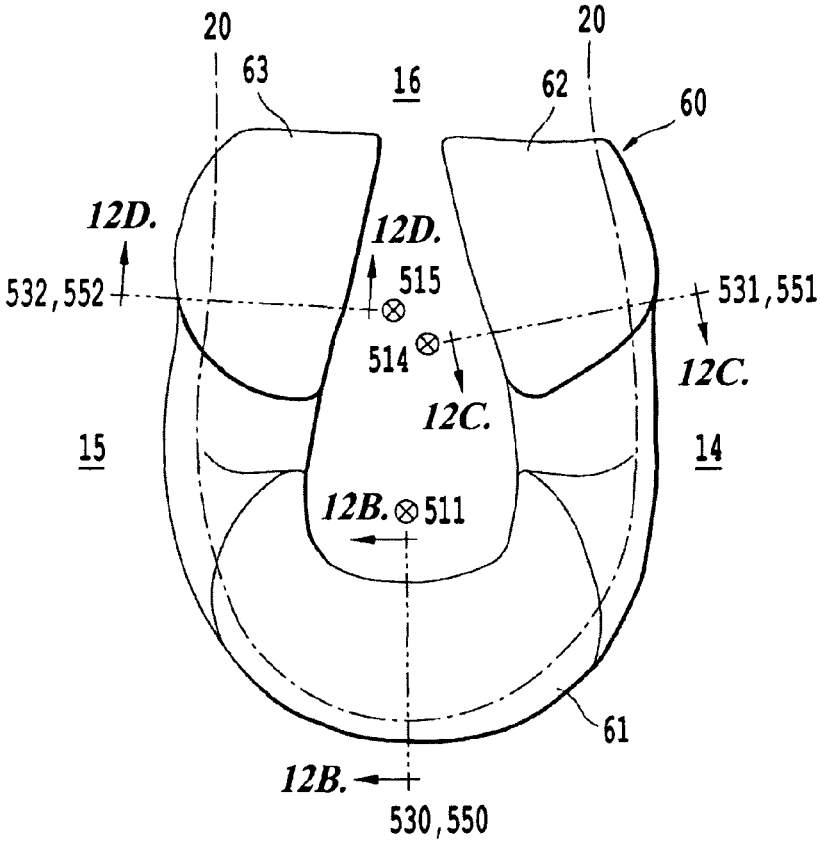
FIG. 12A illustrates a top view of a rear lower midsole according to the first embodiment showing sectionals and the perimeter of the primary midsole superimposed on the rear lower midsole.
Figure 12B:
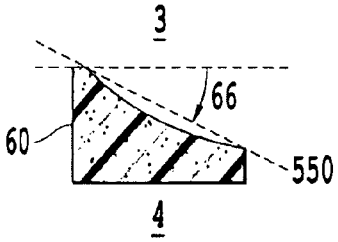
FIG. 12B illustrates a first sectional view of the rear lower midsole according to the first embodiment.
Figure 12C:
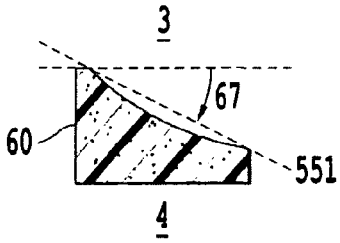
FIG. 12C illustrates a second sectional view of the rear lower midsole according to the first embodiment.
Figure 12D:
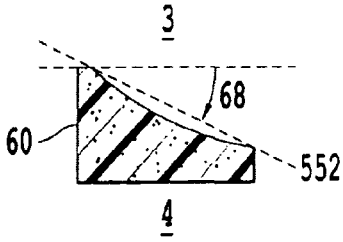
FIG. 12D illustrates a third sectional view of the rear lower midsole according to the first embodiment.

FIGS. 10 and 11 illustrate a rear lower midsole 60 having a set of top surfaces 61, 62, and 63. The rear lower midsole 60 may have a horseshoe shape and a bottom surface 56 of this component may be substantially flat. The bottom surface 56 of the rear cushion 50 may be attached to the rear lower midsole 60 at top surface 61. The top surface 61 may be angled according to a geometric line 550 that is tilted down from horizontal at an angle 66 preferably between 16 to 22 degrees in a geometric vertical plane 530 that may be orthogonal to the perimeter of the primary midsole 20 and intersects a calcaneous bone support location 511 as shown in FIGS. 12A and 12B. The bottom surface 57 of the front inner cushion 51 may be attached to the rear lower midsole 60 at the top surface 62. The top surface 62 may be angled according to a geometric line 551 that is tilted down from horizontal at an angle 67 preferably between 14 to 20 degrees in a geometric vertical plane 531 that may be orthogonal to the perimeter of the primary midsole 20 and intersects a namcular bone support location 514 as shown in FIGS. 12A and 12C. The bottom surface 58 of the front outer cushion 52 may be attached to the rear lower midsole 60 at top surface 63. The top surface 63 may be angled according to a geometric line 552 that is tilted down from horizontal at an angle 68 preferably between 18 to 25 degrees in a geometric vertical plane 532 that may be orthogonal to a the perimeter of the primary midsole 20 and intersects the cuboid bone support location 515 as shown in FIGS. 12A and 12D. The rear lower midsole 60 may be attached to the cushions 50, 51, and 52 via cement glue, epoxy-based adhesive, or the like. The set of cushions 50, 51, and 52 are not directly in contact with each other while attached to the cradle 40 and the rear lower midsole 60.

The rear lower midsole 60 may be made from ethylene vinyl acetate (EVA), polyurethane, compounds having EVA and rubber, polyether urethane, polyester urethane, ethylenevinylacetate/-polyethylene copolymer, polyester elastomer, nitrile rubber, ethylene propylene, polybutadiene, styrene-butadiene (SBR), carboxylated nitrile rubber (XNBR), and the like. The rear lower midsole 60 may have a different density than the primary midsole 20.

Figure 13:
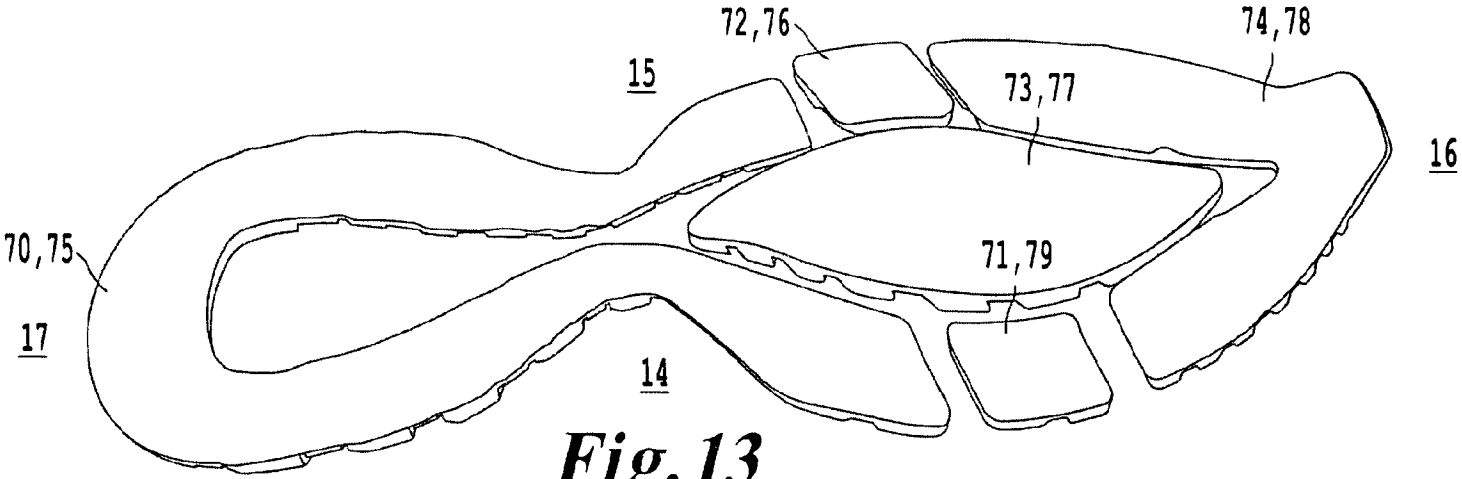
FIG. 13 illustrates a top inner view of an outsole according to the first embodiment.
Figure 14:
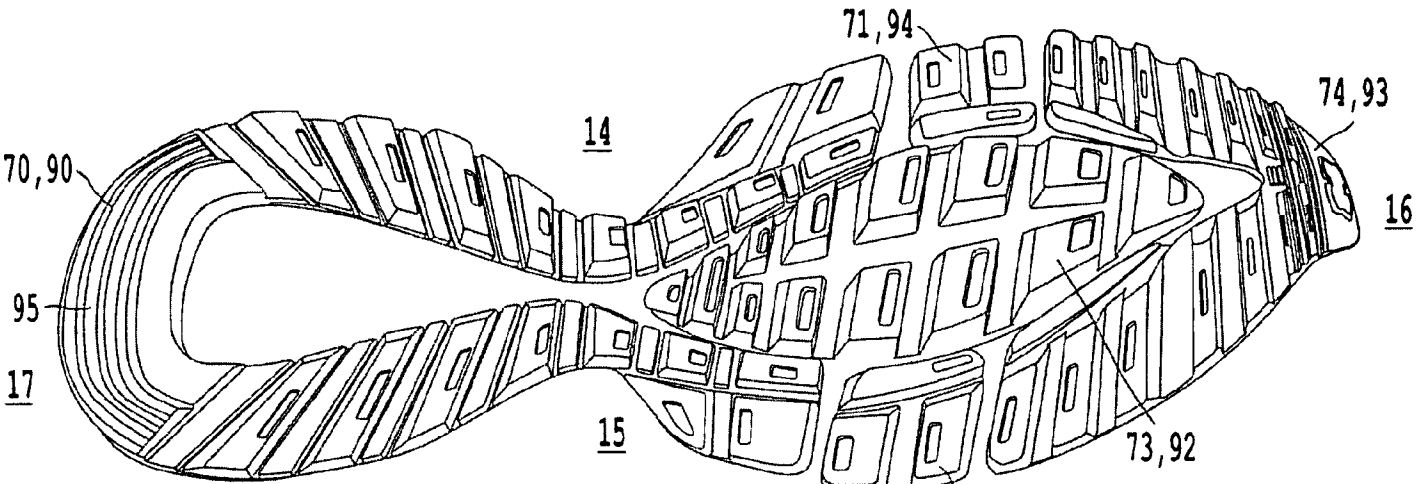
FIG. 14 illustrates a bottom outer view of the outsole according to the first embodiment.

FIG. 13 illustrates a set of outsole components including: a rear outsole 70, an inner lateral outsole 71, an outer lateral outsole 72, a medial outsole 73, and a forefoot outsole 74. The top surface 75 of the rear outsole 70 may be attached to the bottom surface 65 of the rear lower midsole 60, to the cradle 40 at a set of bottom surfaces 48, and to the primary midsole 20 at the bottom surface 23. The inner lateral outsole 71 and the outer lateral outsole 72 may be attached to the primary midsole 20 at surface 23. The medial outsole 73 may be attached to the primary midsole 20 at surface 23. Finally, the forefoot outsole 74 may be attached to both the primary midsole 20 at surface 23. The set of outsole components 70, 71, 72, 73, and 74 may be attached to the other components via cement glue, epoxy-based adhesive, or the like. The outsole components 70, 71, 72, 73, and 74 may be made of the same material or a combination of carbon rubber, blown rubber, or the like. FIG. 14 illustrates the outsole bottom surfaces 90, 91, 92, 93, and 94 that may be configured to contact the ground 2.

FIG. 14 shows a strike point area 95 on the bottom surface 90. The strike point area 95 may be the location where the rear outsole 70 first comes into contact with the ground 2 when a wearer of the shoe is about to plant the foot 18 on the ground during the start of a new stride while running. The cushion 50 may be disposed between the first support position 511 and the strike point area 95. The cushion 51 may be disposed between the second support position 514 and a second location on the rear outsole 70 nearest the second support position 514. The cushion 52 may be disposed between the third support position 515 and a third location on the rear outsole 70 nearest the third support position 515.

Figure 15:
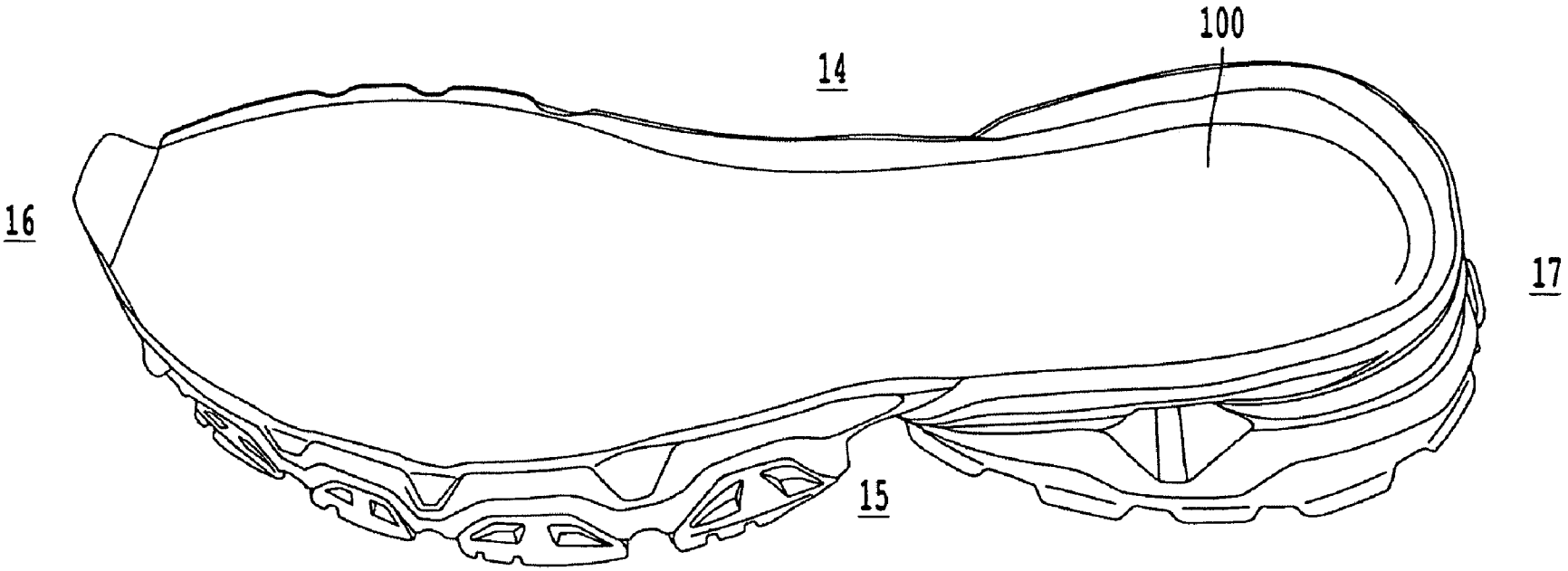
FIG. 15 illustrates a top outer view of a lower according to a second embodiment of the present invention.
Figure 16:
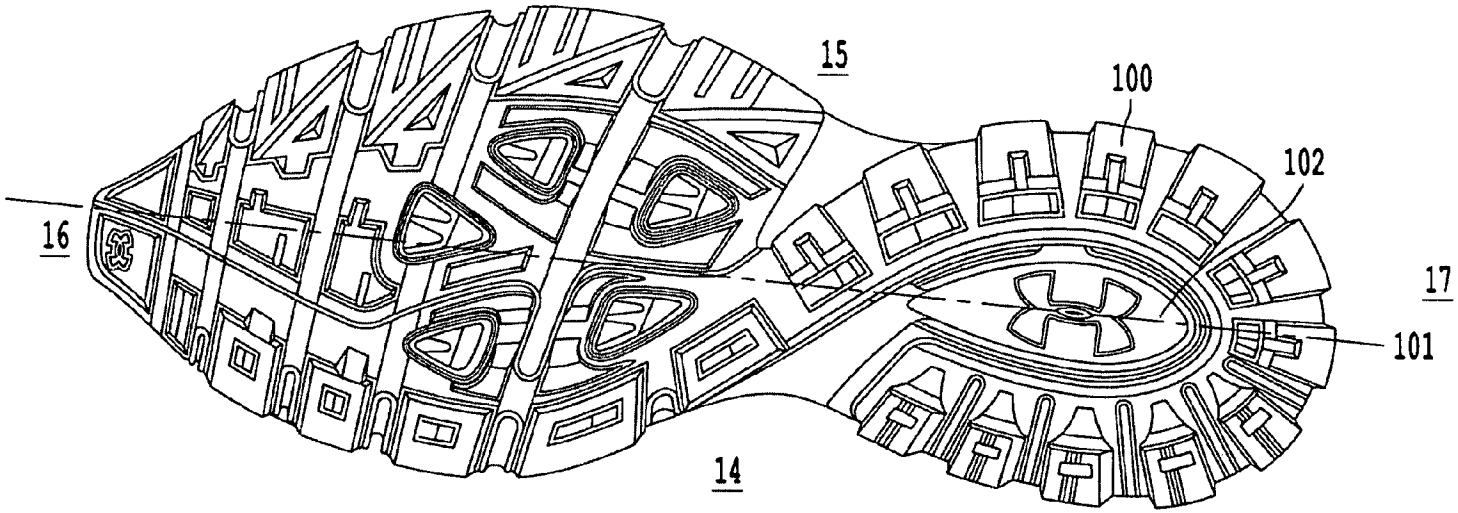
FIG. 16 illustrates a bottom view of the lower according to the second embodiment.
Figure 17:
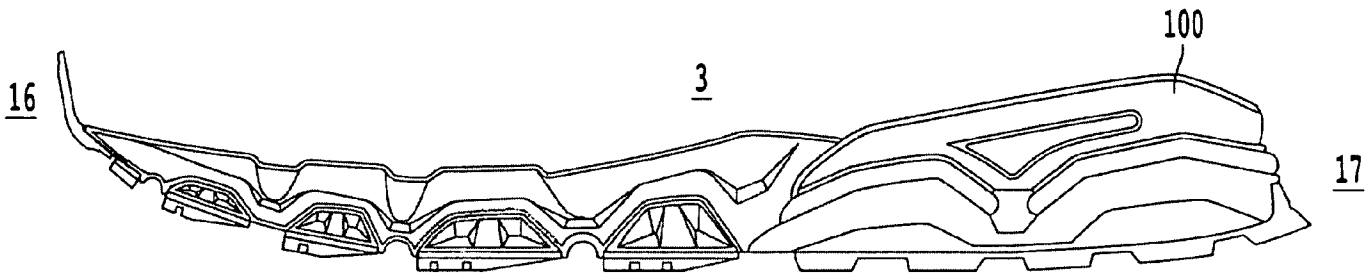
FIG. 17 illustrates an outer lateral view of the lower according to the second embodiment.
Figure 18:
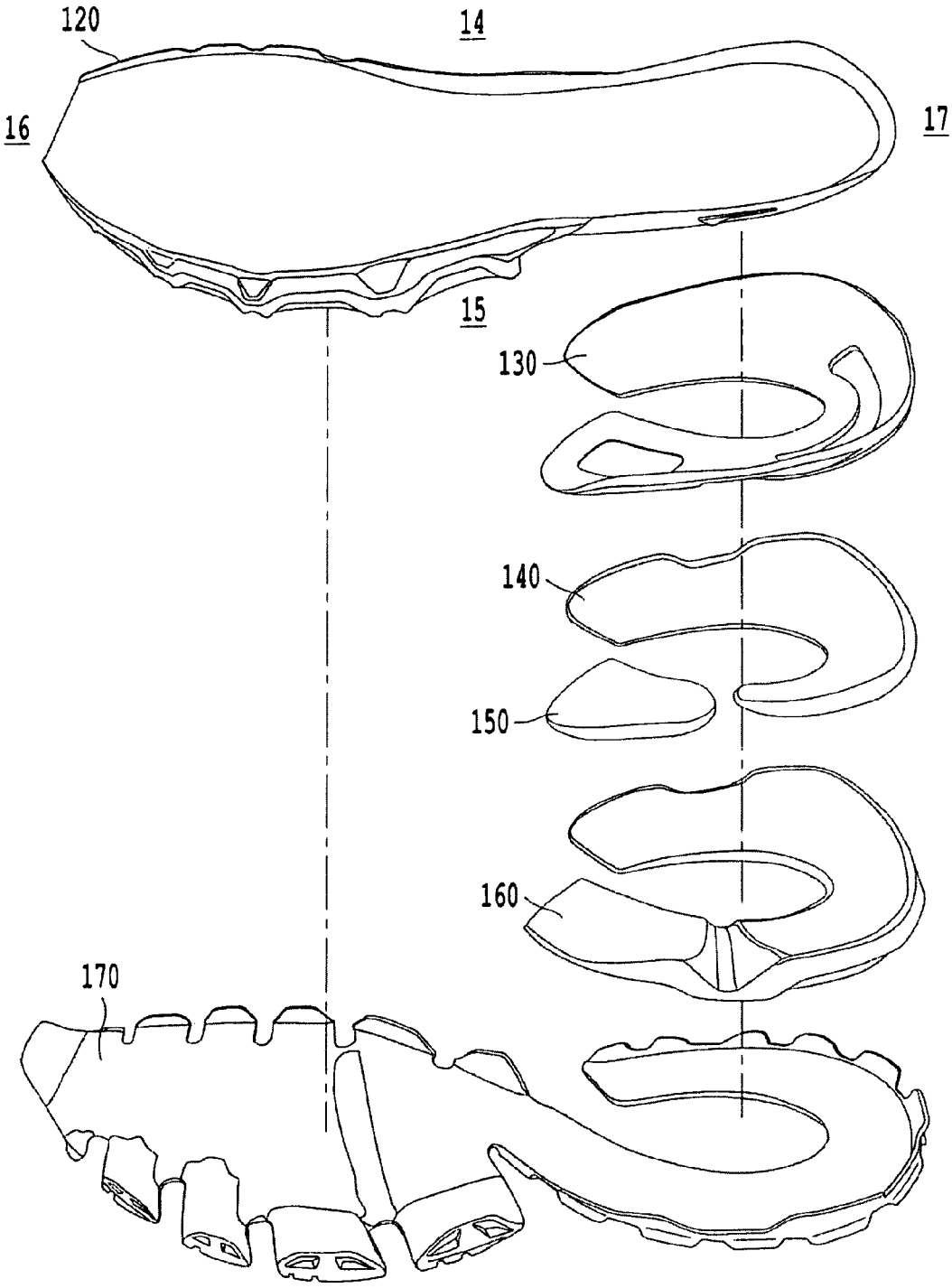
FIG. 18 illustrates an exploded top outer view of the lower according to the second embodiment.

A second embodiment of a lower 100 may be shown by FIGS. 15-17 for use by the wearer's left foot 18. This embodiment may be useful for trail shoes for hikers and features a stiffer construction than the first embodiment. FIG. 18 illustrates the second embodiment which may include a primary midsole 120, directional cradle 130, rear inner cushion 140, front outer cushion 150, rear lower midsole 160, and outsole 170.

Figure 19:
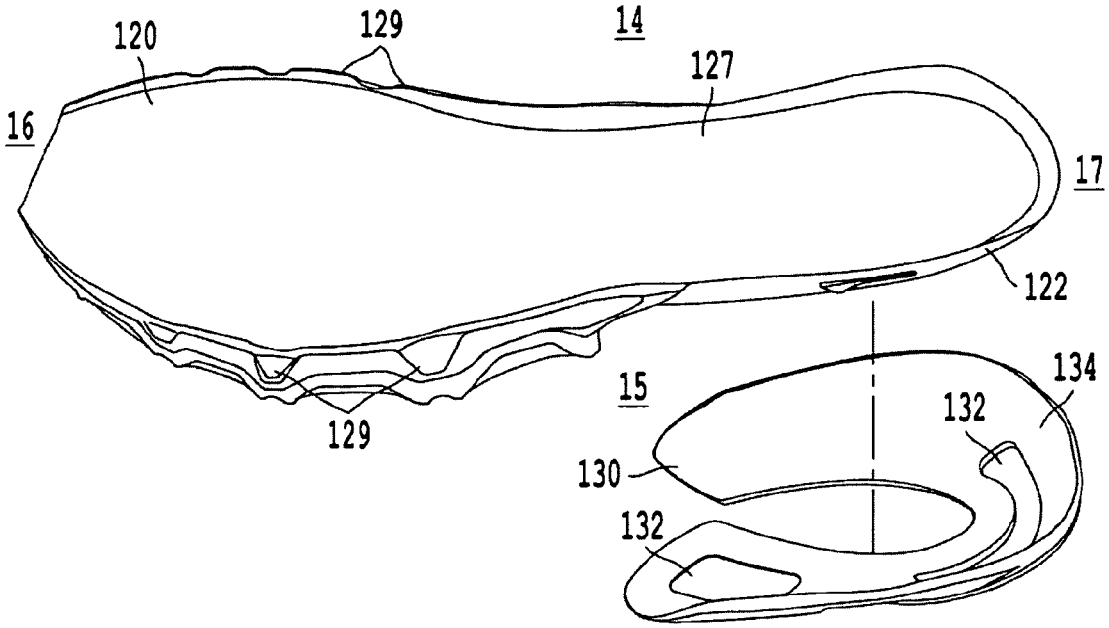
FIG. 19 illustrates a top outer view of a directional cradle and a primary midsole interface according to the second embodiment.

As illustrated in FIG. 19, the primary midsole 120 in this embodiment has a raised border 122 to partially enclose a wearer's heel 510 as part of the top surface 127. The primary midsole 120 may be made from EVA, polyurethane, compounds having EVA and rubber, and the like.

Figure 20:
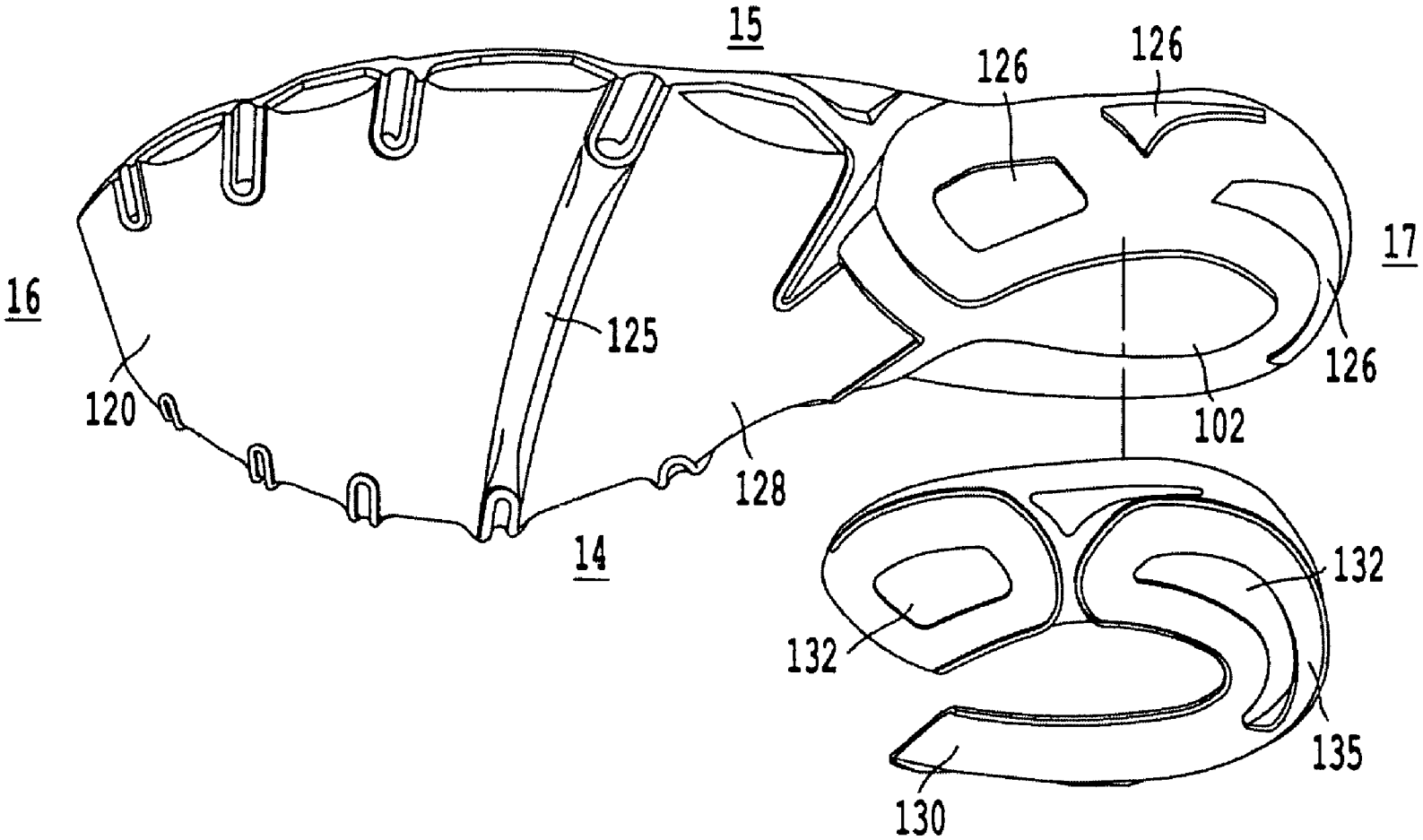
FIG. 20 illustrates a bottom outer view of the directional cradle and the primary midsole interface according to the second embodiment.

FIG. 20 illustrates the bottom surface 128 of the primary midsole 120. The bottom surface 128 includes an interface trench 125 for an interface with the outsole 170 and raised protrusions 126 to interface with the openings 132 on the directional cradle 130. The cradle 130 also includes a top surface 134 and a bottom surface 135. The cradle 130 may be made of polyurethane material, thermoplastic urethane, or the like. The cradle 130 may be attached to the primary midsole 120 so that the raised protrusions 126 fit into the openings 132 and the attachment may be established via cement glue, epoxy-based adhesive, or the like.

Figure 21:
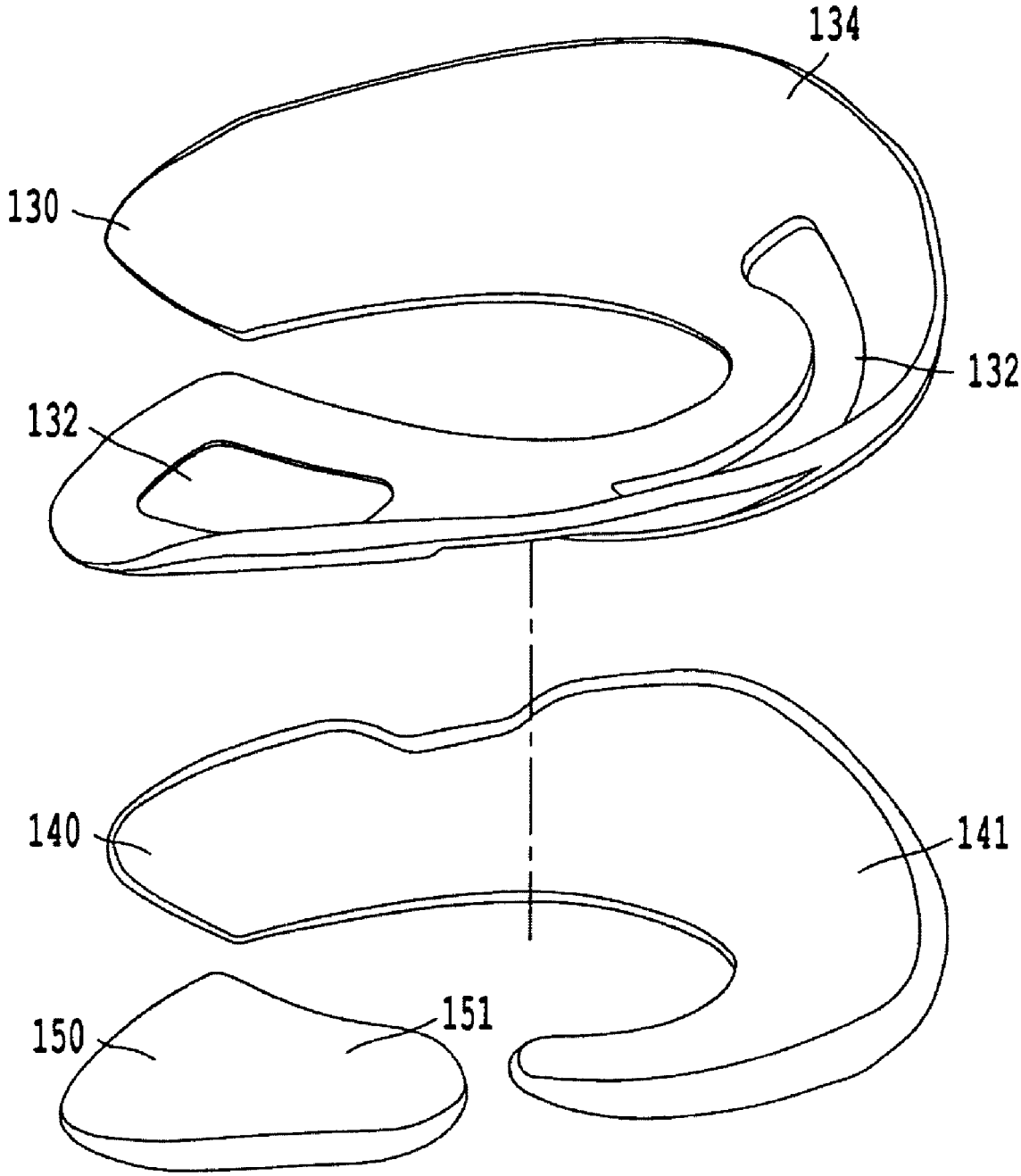
FIG. 21 illustrates a top outer view of the directional cradle and a cushion interface according to the second embodiment.
Figure 22:
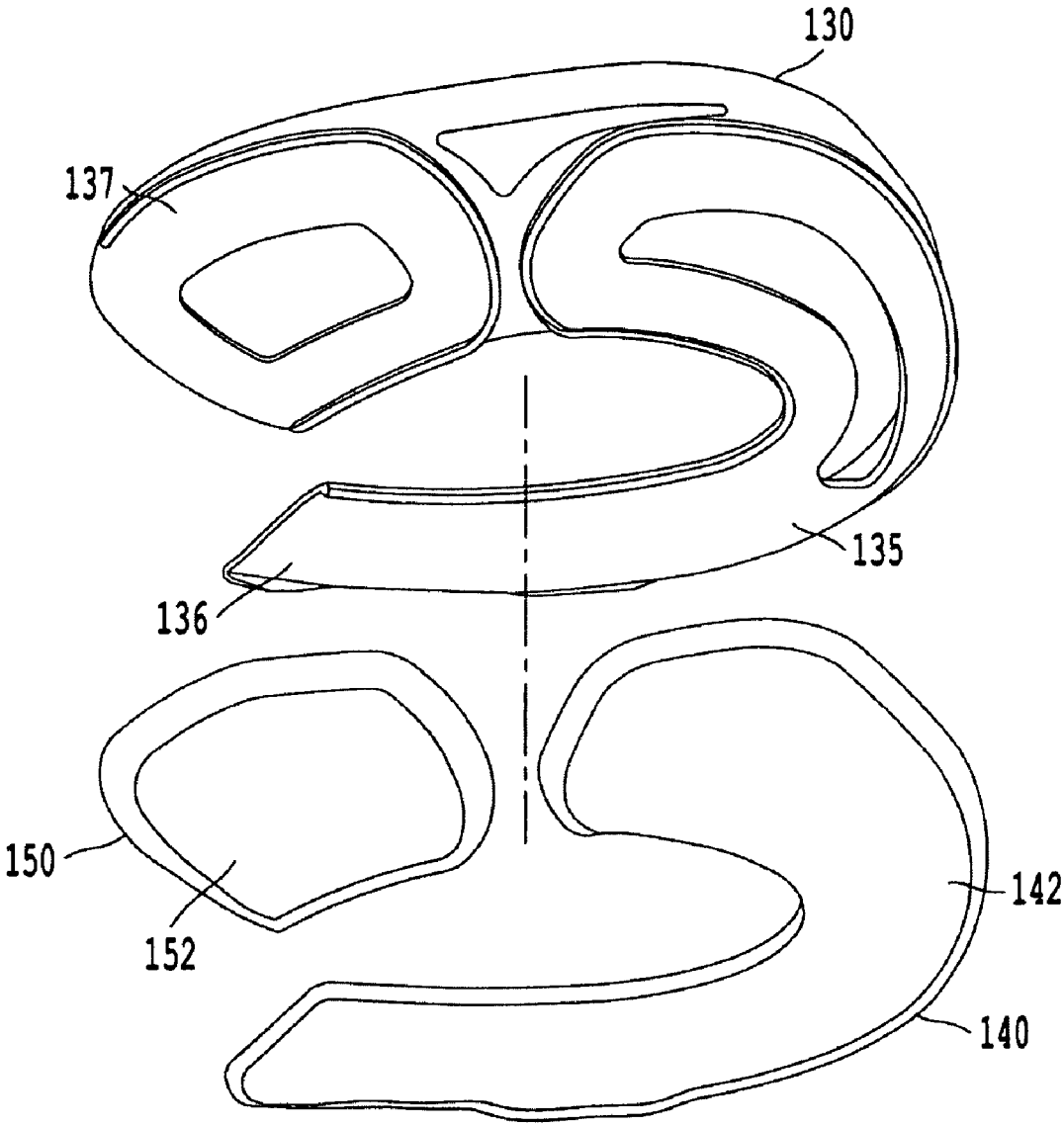
FIG. 22 illustrates a bottom outer view of the directional cradle and the cushion interface according to the second embodiment.

The bottom surface 135 of the cradle 130 also includes a mounting surface 136 and a mounting surface 137. A top surface 141 of rear inner cushion 140 may be shown by FIG. 21. This surface 141 may be attached to the mounting surface 136 on the cradle 130. The mounting surface 136 may be shown in FIG. 22. The top surface 151 of front outer cushion 150 may be attached to the mounting surface 137 on the cradle 130. The cushions 140 and 150 may be made of polymer gel, polyurethane gel, silicone rubber, thermoplastic rubber, polyurethane foam, or the like.

Figure 23A:
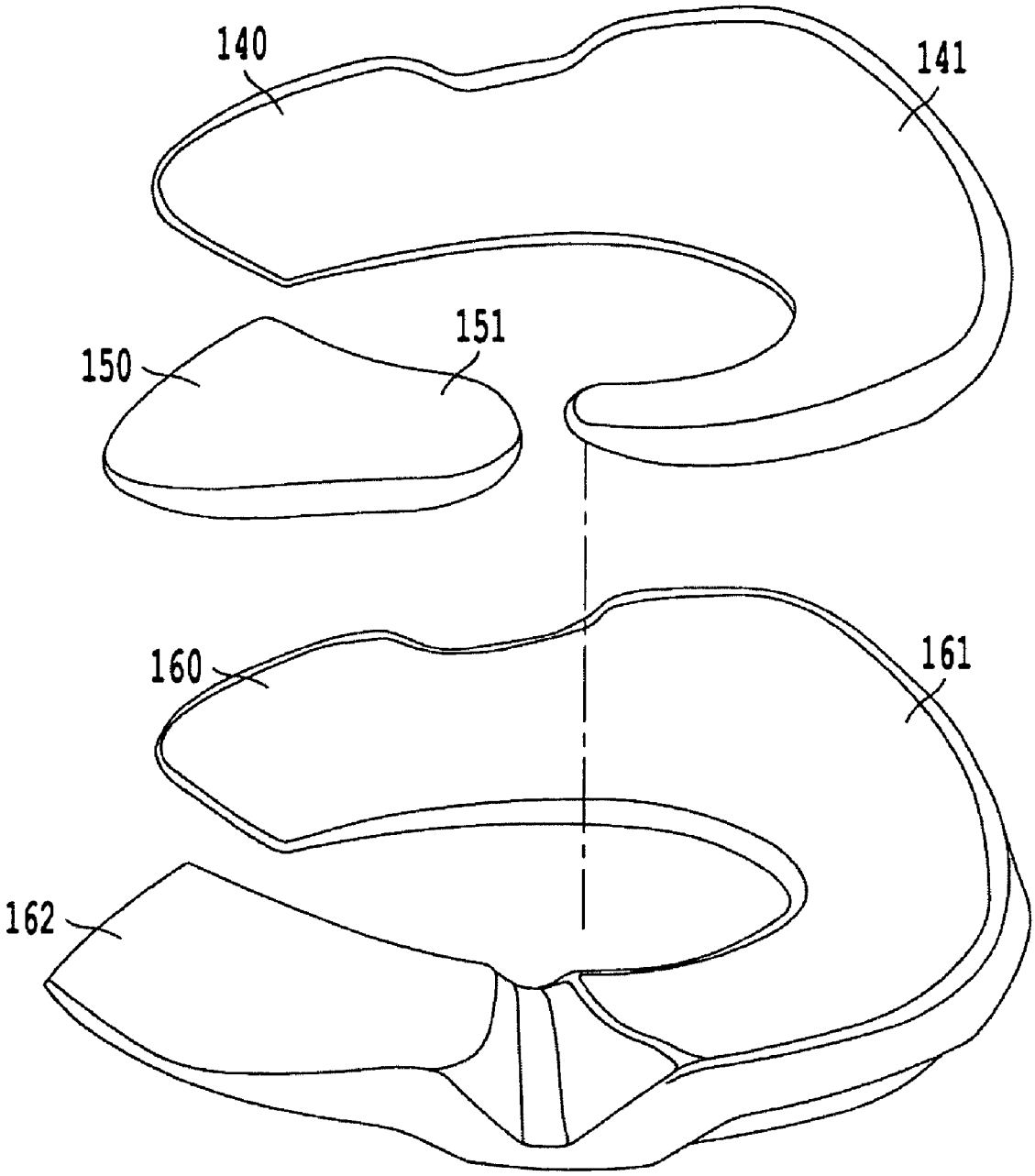
FIG. 23A illustrates a top inner view of a rear lower midsole and the cushion interface according to the second embodiment.
Figure 23B:
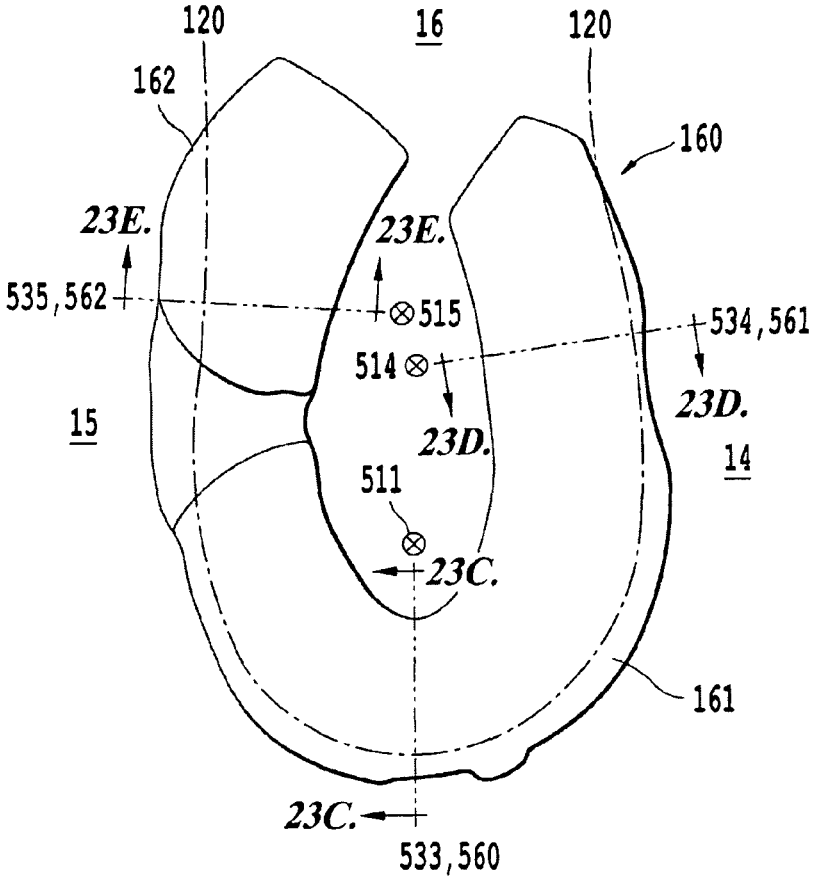
FIG. 23B illustrates a top view of a rear lower midsole according to the first embodiment showing sectionals and the perimeter of the primary midsole superimposed on the rear lower midsole.
Figure 23C:
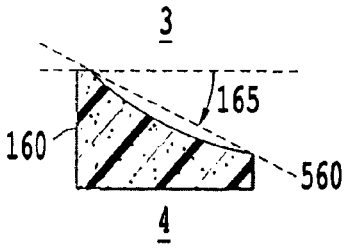
FIG. 23C illustrates a first sectional view of the rear lower midsole according to the first embodiment.
Figure 23D:
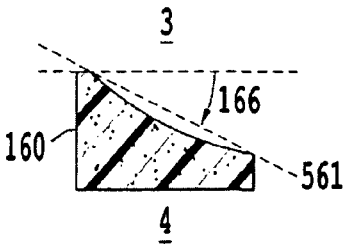
FIG. 23D illustrates a second sectional view of the rear lower midsole according to the first embodiment.
Figure 23E:
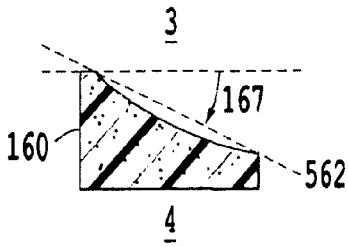
FIG. 23E illustrates a third sectional view of the rear lower midsole according to the first embodiment.

FIG. 23A illustrates the rear lower midsole 160 having top surface 161 and top surface 162. The top surface 161 near the back 17 may be angled according to a geometric line 560 that is tilted down from horizontal at an angle 165 preferably between 15 to 21 degrees in a geometric vertical plane 533 that may be orthogonal to the perimeter of the primary midsole 120 and intersects the calcaneous bone support location 511 as shown in FIGS. 23B and 23C. The top surface 161 near the inner lateral 14 may be angled according to a geometric line 561 that is tilted down from horizontal at an angle 166 preferably between 20 to 26 degrees in a geometric vertical plane 534 that may be orthogonal to the perimeter of the primary midsole 120 and intersects the namcular bone support location 514 as shown in FIGS. 23B and 23D. The bottom surface 142 of the rear inner cushion 140 may be attached to the top surface 161 and the bottom surface 152 of the front outer cushion 150 may be attached to the top surface 162. The top surface 162 may be angled according to a geometric line 562 that tilted down from horizontal at an angle 167 preferably between 15 to 21 degrees in a geometric vertical plane 535 that may be orthogonal to the perimeter of the primary midsole 120 and intersects the cuboid bone support location 515 as shown in FIGS. 23B and 23E. The rear inner cushion 140 and the front outer cushion 150 may be attached to the cradle 130 and rear lower midsole 160 via cement glue, epoxy-based adhesive, or the like. The set of cushions 140 and 150 may not be directly in contact with each other while attached to the cradle 130 and the rear lower midsole 160.

Figure 24:
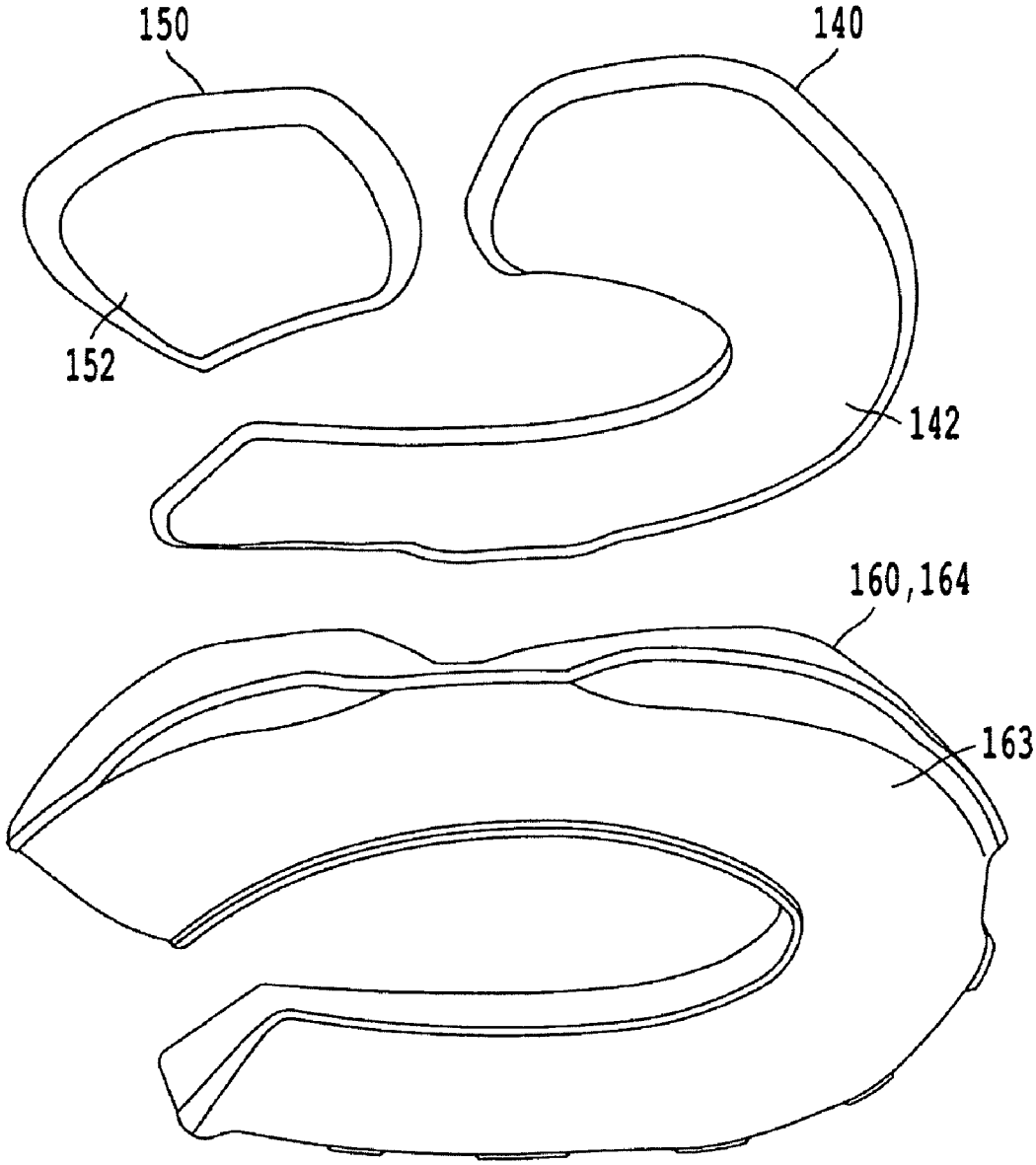
FIG. 24 illustrates a bottom outer view of the rear lower midsole and the cushion interface according to the second embodiment.
Figure 25:
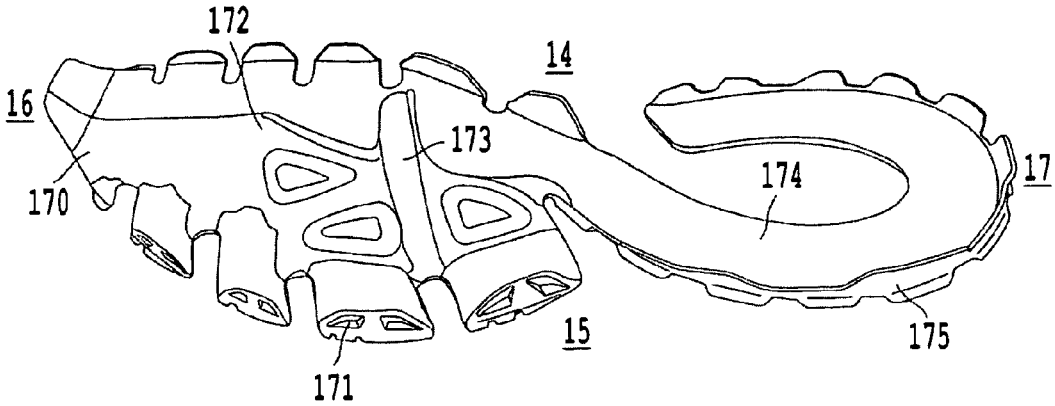
FIG. 25 illustrates a top outer view of an outsole according to the second embodiment.
Figure 26:
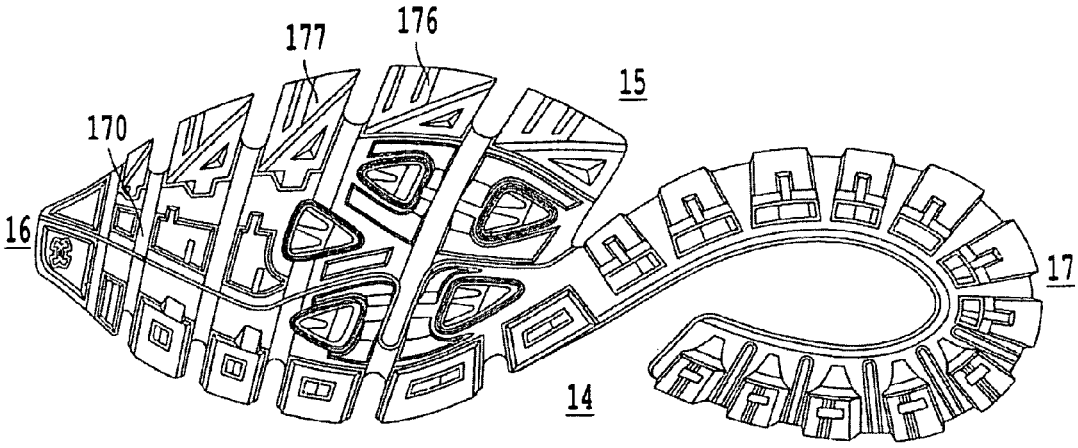
FIG. 26 illustrates a bottom view of the outsole according to the second embodiment.

FIG. 24 shows the bottom surface 163 of the rear lower midsole 160. The outsole 170 may be attached to the bottom surface 163. The outsole 170 may also be attached via a flat surface 172 to the bottom surface 128 of the primary midsole 120. An interface trench 125 on the bottom of the primary midsole 120 may be adapted to interface with an elongated protrusion 173 on the top of the outsole 170. A set of non-pigmented sole knobs 176 and a set of pigmented sole knobs 177 of the outsole 170 may be configured to interface with a set of contoured sides 129 on the primary midsole 120. The outsole 120 may be attached to the rear lower midsole 160 and primary midsole 120 via cement glue, epoxy-based adhesive, or the like.

FIG. 16 shows a centerline 101 for the lower 100 of the second embodiment. A bottom surface portion 102 of the primary midsole 120 protrudes through the cradle 130 on the centerline 101. The bottom surface portion 102 is disposed under the heel 501 when the foot 18 has been inserted within the shoe 1. The bottom surface 102 of the primary midsole 120 may be free of attachments to the cushions 140, 150, rear lower midsole 160, and the outsole 170. The surface 102 of the primary midsole 120 faces the ground 2, but may not contact the ground 2 when the outsole surface 177 may be in contact with the ground. The heel 501 may experience more lateral stability and other benefits by having the bottom surface 102 unsupported from below 4 as described in this manner.

Figure 27:
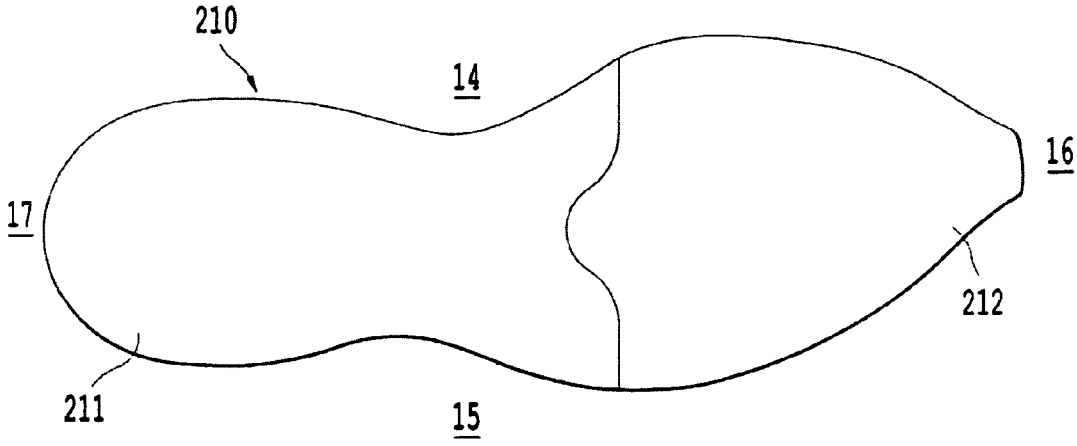
FIG. 27 illustrates a bottom view of a primary midsole according to a third embodiment of the present invention.
Figure 28:
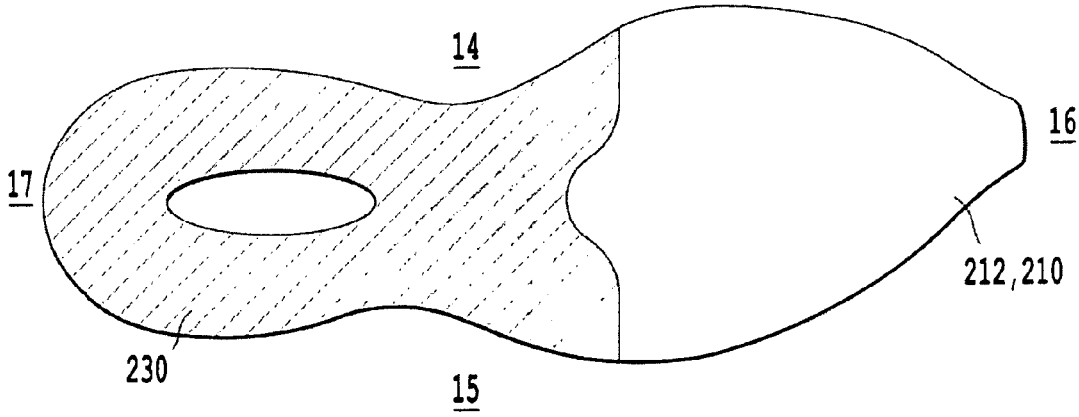
FIG. 28 illustrates a bottom view of the primary midsole and a directional cradle attached according to the third embodiment.
Figure 29:
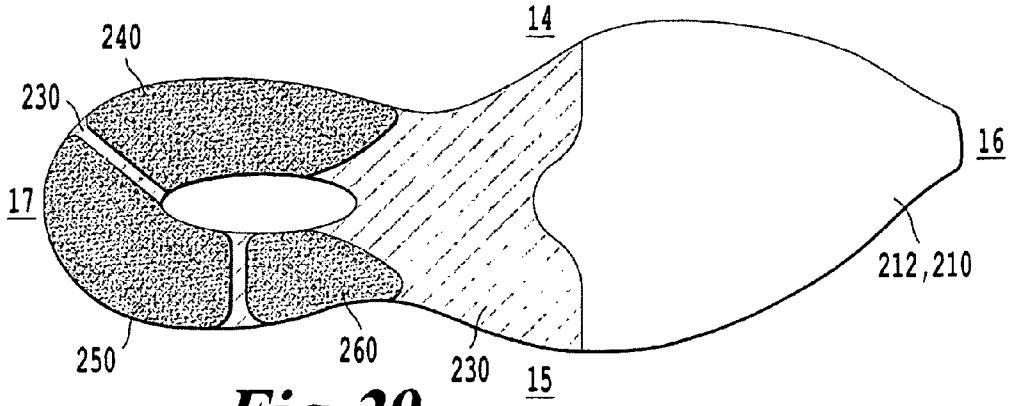
FIG. 29 illustrates a bottom view of the primary midsole, the directional cradle, and a set of three cushions attached according to the third embodiment.
Figure 30:
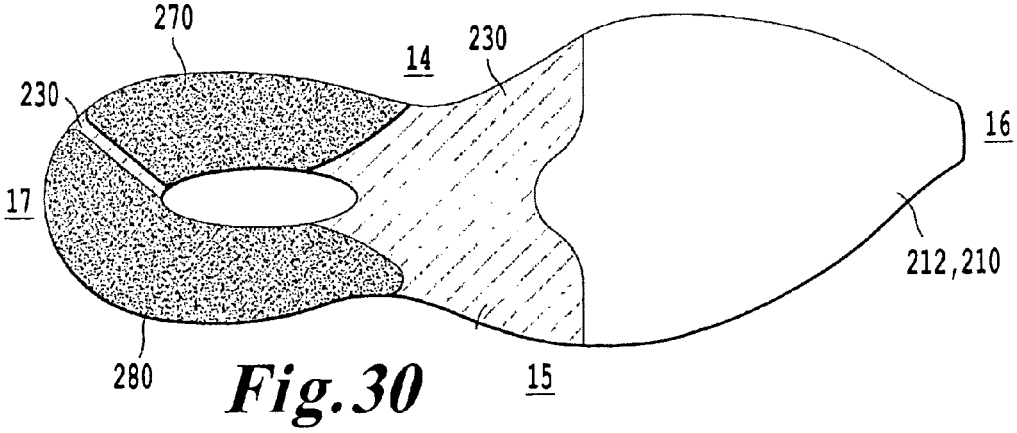
FIG. 30 illustrates a bottom view of the primary midsole, the directional cradle, the set of three cushions, an outer rear lower midsole, and an inner rear lower midsole attached according to the third embodiment.
Figure 31:
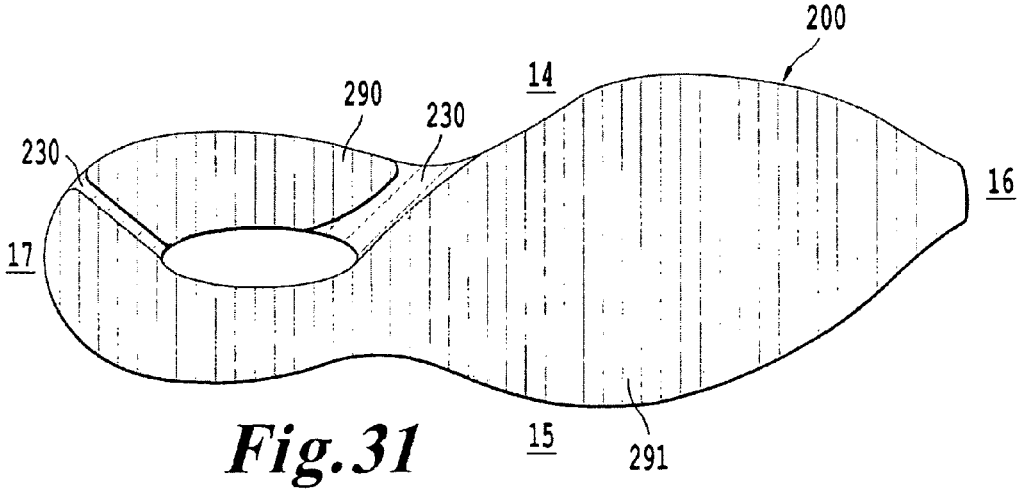
FIG. 31 illustrates a bottom view of the primary midsole, the directional cradle, the set of three cushions, the outer rear lower midsole, the inner rear lower midsole, and an outsole attached according to the third embodiment.
Figure 32:
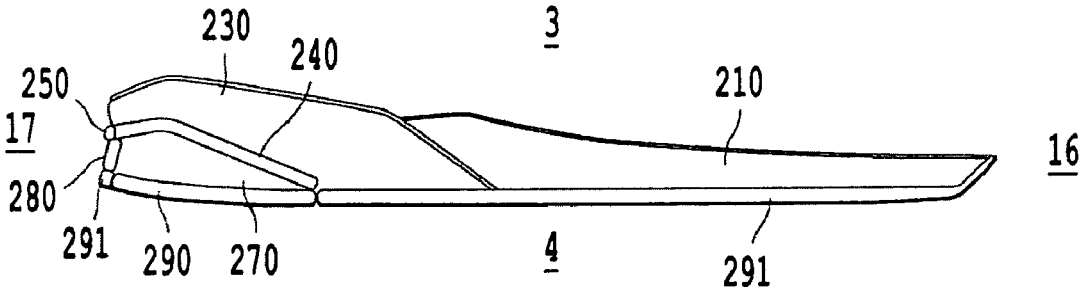
FIG. 32 illustrates an inner lateral view of the third embodiment.
Figure 33:
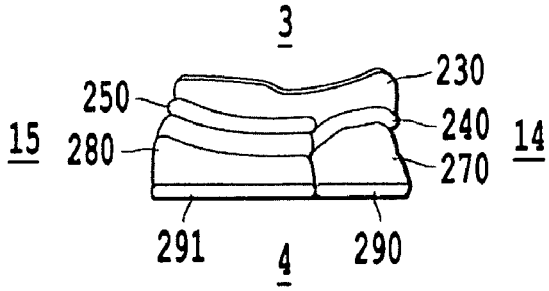
FIG. 33 illustrates a back view of the third embodiment.

In a third embodiment, a lower 200 includes a primary midsole 210, a directional cradle 230, an inner cushion 240, an outer rear cushion 250, an outer front cushion 260, an inner rear lower midsole 270, an outer rear lower midsole 280, a first outsole 290, and a second outsole 291. FIG. 27 shows a primary midsole 210 having a rear surface 211, a front raised surface 212, and a sunken medial surface 213. FIG. 28 shows a directional cradle 230 attached to the rear surface 211 illustrated in FIG. 27. FIG. 29 shows the inner cushion 240, the outer rear cushion 250, and the outer front cushion 260 attached to the cradle 230 illustrated in FIG. 28. FIG. 30 shows the inner rear lower midsole 270 attached to the inner cushion 240 as illustrated in FIG. 29. FIG. 30 also shows the outer rear lower midsole 280 attached to both the outer rear cushion 250 and outer front cushion 260 as illustrated in FIG. 29. FIG. 31 shows the outsole 290 attached to the inner rear lower midsole 270. FIG. 31 also shows the second outsole 291 attached to the outer rear lower midsole 280, the cradle 230, and the primary midsole 210. FIG. 32 shows this third embodiment from an inner lateral view and FIG. 33 shows it from the back.

Figure 34A:
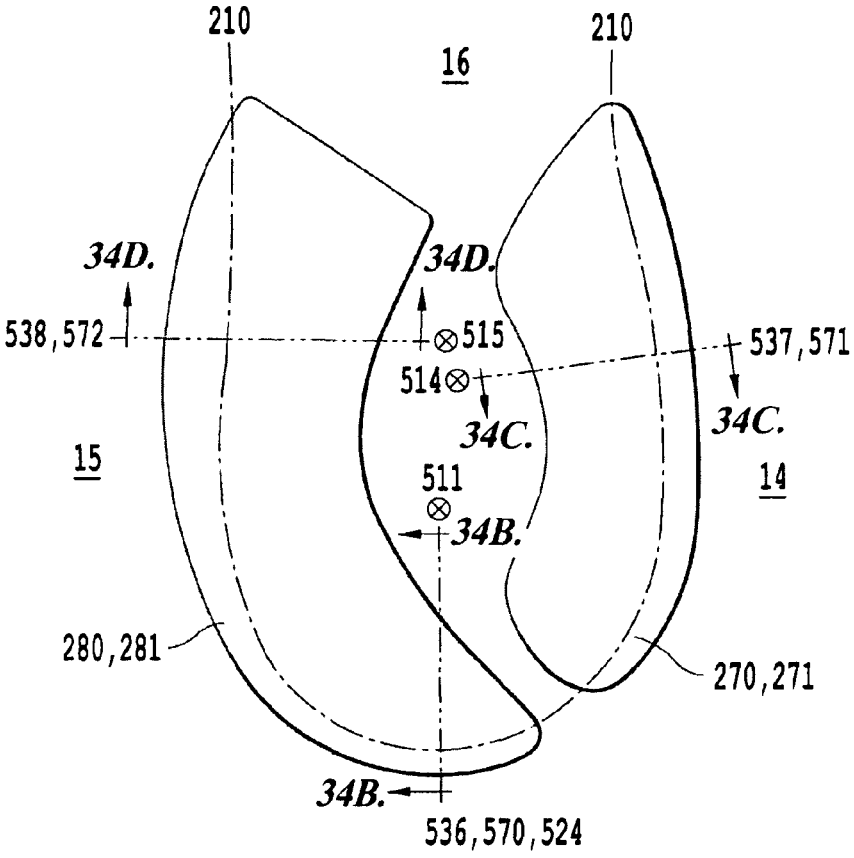
FIG. 34A illustrates a top view of the inner rear lower midsole and the outer rear lower midsole arranged in relative positions as if attached according to the third embodiment, as well as and the perimeter of the primary midsole superimposed on the inner rear lower midsole and the outer rear lower midsole.
Figure 34B:
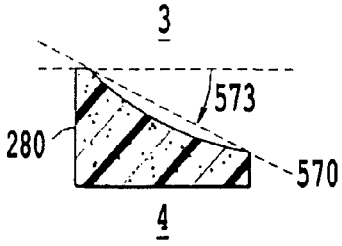
FIG. 34B illustrates a first sectional view of the rear lower midsole according to the third embodiment.
Figure 34C:
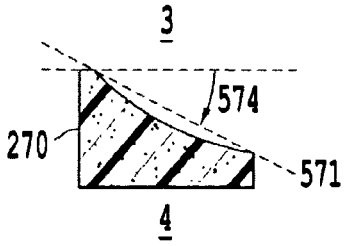
FIG. 34C illustrates a second sectional view of the rear lower midsole according to the third embodiment.
Figure 34D:
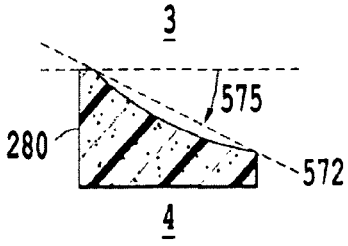
FIG. 34D illustrates a third sectional view of the rear lower midsole according to the third embodiment.

As illustrated in FIG. 34A, the outer rear midsole 280 includes a top surface 281 and the inner rear midsole 270 includes a top surface 271. The outer rear midsole 280 may be made of materials having different firmness and cushioning characteristics than the inner rear midsole 270. The top surface 281 near the back 17 may be angled according to a geometric line 570 that is tilted down from horizontal at an angle 573 preferably between 34 to 40 degrees in a geometric vertical plane 536 that may be orthogonal to the perimeter of the primary midsole 210 and intersects the calcaneous bone support location 511 as shown in FIGS. 34A and 34B. The top surface 271 near the inner lateral 14 may be angled according to a geometric line 571 that is tilted down from horizontal at an angle 574 preferably between 25 to 31 degrees in a geometric vertical plane 537 that is orthogonal to the perimeter of the primary midsole 210 and intersects the namcular bone support location 514 as shown in FIGS. 34A and 34C. The top surface 281 near the outer lateral side 15 may be angled according to a geometric line 572 that is tilted down from horizontal at an angle 575 preferably between 20 to 26 degrees in a geometric vertical plane 538 that is orthogonal to perimeter of the primary midsole 210 and intersects the cuboid bone support location 515 as shown in FIGS. 34A and 34D.

Figure 35A:
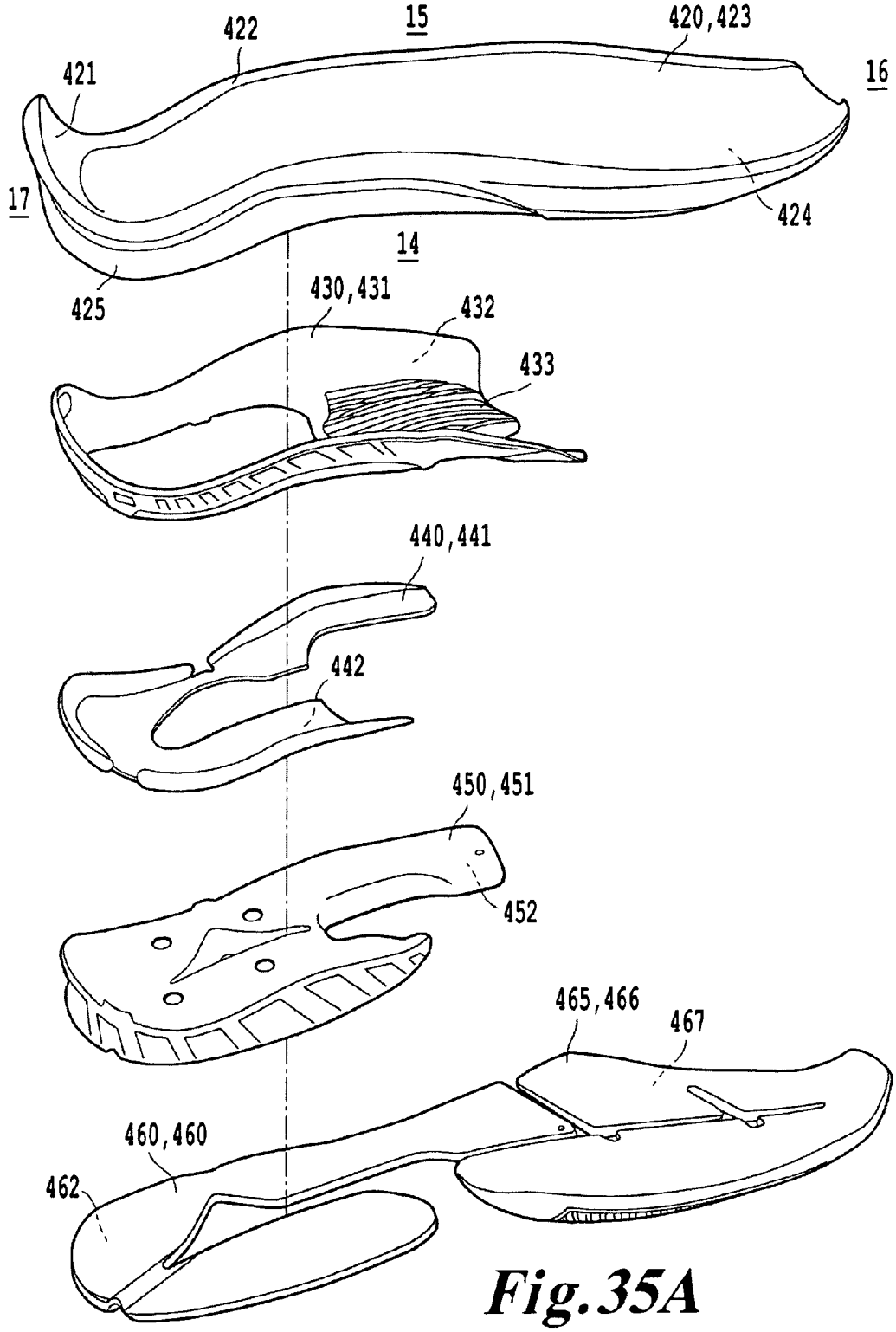
FIG. 35A illustrates an exploded top inner view of the lower according to the fourth embodiment.
Figure 35B:
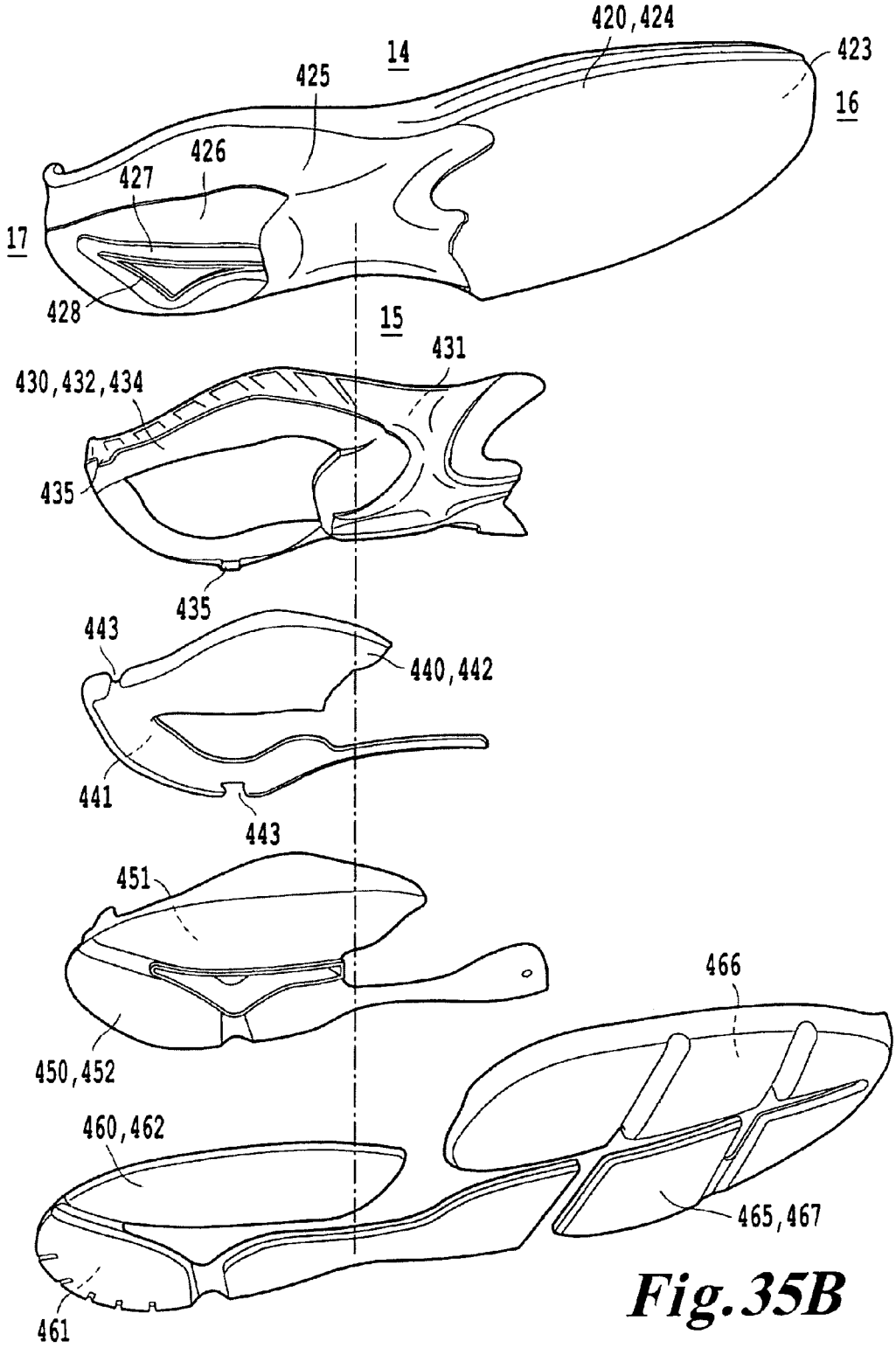
FIG. 35B illustrates an exploded bottom inner view of the lower according to the second embodiment.

A fourth embodiment of a lower 100 may be shown by FIGS. 35A-35B for use by the wearer's left foot 18. This embodiment may be advantageous for basketball activity and features a construction optimized for lateral stability, traction, and tactile "court-feel" compared to the first embodiment. FIG. 35A illustrates the fourth embodiment which may include a primary midsole 420, directional cradle 430, rear cushion 440, rear lower midsole 450, rear outsole 460, and front outsole 465.

As illustrated in FIG. 35A, the primary midsole 420 in this embodiment has a raised border 422 to partially enclose a wearer's heel 510 as part of the top surface 423. The midsole also may have a pronounced raised heel edge 421 to further support the wearer's heel 510. The primary midsole 420 may be made from EVA, polyurethane, compounds having EVA and rubber, and the like.

FIG. 35B illustrates the bottom surface 424 of the primary midsole 420. The bottom surface 424 includes a sunken surface 425 to interface with a top surface 431 of the directional cradle 430 and a first raised surface 426 to interface with the top surface 441 of the cushion 440. The bottom surface 424 also includes a second raised surface 427 to interface with a top surface 451 of the rear lower midsole 450.

The cradle 430 includes the top surface 431 and a bottom surface 432. The top surface 431 includes a plurality of raised grooves 433 that are aligned substantially parallel to the wearer's foot 18 consistent with the front 16 to the back 17 directions of the shoe 1. The grooves 433 may contact the bottom surface 425 of the primary midsole 420, however may be designed to not contact the cushion 440. The grooves 433 may assist in the lateral stability of the shoe 1. The cradle 430 may be made of polyurethane material, tevax, thermoplastic urethane, or the like. The cradle 430 may be attached to the primary midsole 420 via cement glue, epoxy-based adhesive, or the like.

The bottom surface 432 of the cradle 430 also includes a mounting surface 434. A top surface 441 of the cushion 440 may be shown by FIG. 35A. This top surface 441 may be attached to the mounting surface 434 on the cradle 430. The mounting surface 434 may be shown in FIG. 35B. In this embodiment, the cushion 440 may have a top surface 441 and a bottom surface 442. The two surfaces 441, 442 may not be substantially parallel and thereby allow for variable thicknesses. The cushion 440 may be constructed using an injection-molding technique or other method. The cushion 440 may be made of polymer gel, polyurethane gel, silicone rubber, thermoplastic rubber, polyurethane foam, or the like.

Figure 36A:
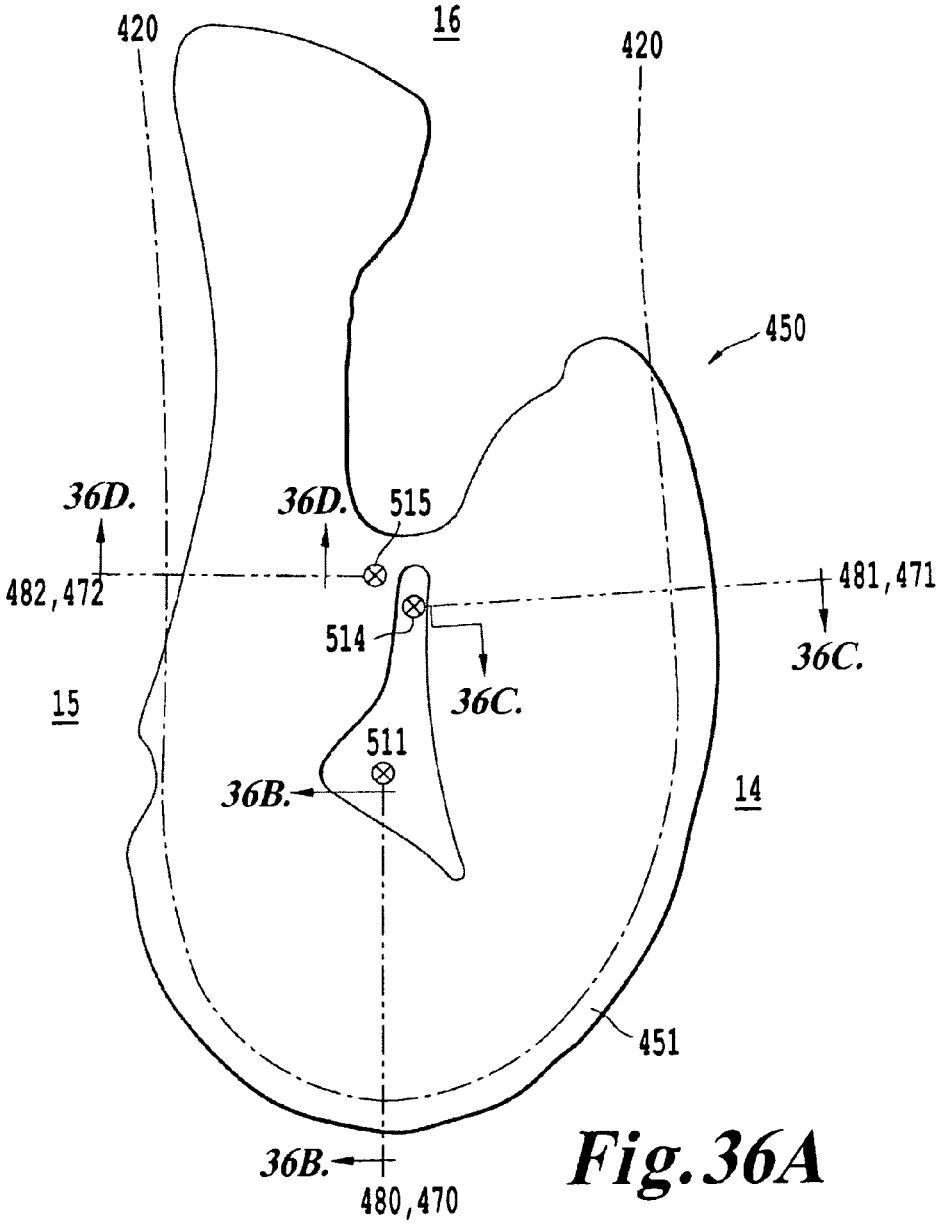
FIG. 36A illustrates a top view of a rear lower midsole according to the fourth embodiment showing sectionals and the perimeter of the primary midsole superimposed on the rear lower midsole.
Figure 36B:
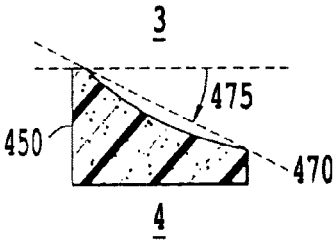
FIG. 36B illustrates a first sectional view of the rear lower midsole according to the fourth embodiment.
Figure 36C:
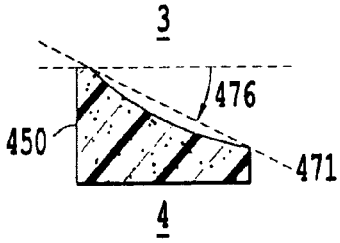
FIG. 36C illustrates a second sectional view of the rear lower midsole according to the fourth embodiment.
Figure 36D:
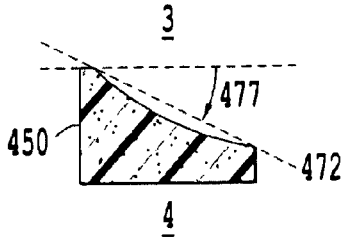
FIG. 36D illustrates a third sectional view of the rear lower midsole according to the fourth embodiment.

FIG. 35A illustrates the rear lower midsole 450 having a top surface 451 and a bottom surface 452. The top surface 451 near the back 17 may be angled according to a geometric line 470 that is tilted down from horizontal at an angle 160 preferably between 14 to 20 degrees in a geometric vertical plane 480 that is orthogonal to the perimeter of the primary midsole 420 and intersects the calcaneous bone support location 511 as shown in FIGS. 36A and 36B. The top surface 451 near the inner lateral 14 may be angled according to a geometric line 471 that is tilted down from horizontal at an angle 476 preferably between 10 to 17 degrees in a geometric vertical plane 481 that is orthogonal to the perimeter of the primary midsole 420 and intersects the namcular bone support location 514 as shown in FIGS. 36A and 36C. The bottom surface 452 of the cushion 450 may also be attached to a portion of the top surface 451 near the outer lateral 15. This portion of top surface 451 may be angled according to a geometric line 472 that tilted down from horizontal at an angle 477 preferably between 3 to 10 degrees in a geometric vertical plane 482 that is orthogonal to the perimeter of the primary midsole 420 and intersects the cuboid bone support location 515 as shown in FIGS. 36A and 36D. The cushion 440 may be attached to the cradle 430, the primary midsole 420, and rear lower midsole 450 via cement glue, epoxy-based adhesive, or the like.

The cushion 440 may be attached to the primary midsole 420 at the second raised surface 427. The cushion 440 may have a horseshoe shape. The attachment is assisted by structures on the cradle 430 and the cushion 440. One or more alignment slots 443 on the cushion 440 may be aligned relative to the cradle 430 via one of more alignment tabs 435. The one or more alignment tabs 435 may be integrated as part of the cradle 430 as protrusions.

FIG. 35B shows the bottom surface 452 of the rear lower midsole 450 and this may be attached to the rear outsole 460. The rear outsole 120 may also be attached to the rear lower midsole 160, the cradle 430, and primary midsole 420 via cement glue, epoxy-based adhesive, or the like. This embodiment was described with a two-piece outsole, but a single piece outsole, or an outsole with more than two components is also possible.

A bottom surface portion 428 of the primary midsole 420 may protrude through the cradle 430. The bottom surface portion 428 is disposed under the heel 501 when the foot 18 has been inserted within the shoe 1. The bottom surface portion 428 of the primary midsole 420 may be unattached to the cradle 430, the cushion 440 and the rear outsole 460. The surface portion 428 of the primary midsole 420 faces the ground 2, but may not contact the ground 2 when the bottom rear outsole surface 462 may be in contact with the ground. Lateral stability may be improved by having the bottom surface 102 unsupported from below 4 as described in this manner.

All embodiments of the lower are intended to be used by the wearer in a similar way. The wearer inserts the foot 18 into the upper 5. The wearer fastens the upper 5, as needed, to the foot 18 so that there is a comfortable fit and the foot 18 is disposed between the upper 5 and the lower 6. The wearer may engage in whatever activity desired so that the outsole 70 may have a set of impacts with the ground 2. The set of impacts cause a set of forces to be applied to the outsole 70 that are partially dampened by the rear lower midsole 60 and further dampened by the rear cushion 50, the front inner cushion 51, and the front outer cushion 52. The dampened set of forces may provide a safer and less tiring experience to the wearer than without damping. Further, during the activity the wearer may run side-to-side with quick cuts and the side-to-side forces subsequently created and applied to the outsole 70 may be dampened by the cushions 50, 51, 52 attached to the top surfaces 61, 62, 63 that are tilted down at an established set of angles to absorb these forces and provide lateral stability. The softness of material used for the cushions allow a much thinner lower to be created and with less weight than if the entire lower were to be manufactured using traditional approaches. When the activity has been completed the wearer merely unfastens the upper 5 as needed and removes the foot 18 from the opening 19.

Further, it should be appreciated that the exemplary embodiments of the invention are not limited to the exemplary embodiments shown and described above. While this invention has been described in conjunction with exemplary embodiments outlined above, various alternatives, modifications, variations and/or improvements, whether known or that are, or may be, presently unforeseen, may become apparent. Accordingly, the exemplary embodiments of the invention, as set forth above are intended to be illustrative, not limiting. The various changes may be made without departing from the spirit and scope of the invention. Therefore, the systems and methods according to exemplary embodiments of this invention are intended to embrace all now known or later-developed alternatives, modifications, variations and/or improvements.

We claim:

1. A shoe having an upper and a lower, the lower comprising:

a primary midsole, configured to have a top surface and a bottom surface, the top surface to contact a set of five toes of the foot, the top surface having a periphery that curves up around a bottom of a heel of the foot;

a directional cradle configured to being attached to the primary midsole, the cradle having a cradle top surface and a cradle bottom surface, the cradle top surface having a concave shape curving up around the bottom of a foot;

a first cushion configured to being attached to the directional cradle, the first cushion being made of a flexible planar material with a first top surface and a first bottom surface, the first top surface disposed in a first concave shape about the cradle;

a rear lower midsole configured to being attached to the first cushion, the rear lower midsole having a bottom surface that is substantially flat and a top surface that is angled relative to the bottom surface; and an outsole configured to being attached to the bottom surface of the rear lower midsole, the directional cradle, and the primary midsole.

2. The shoe according to claim 1, wherein the shoe further comprises:

a second cushion configured to being attached to the directional cradle and the rear lower midsole, the second cushion being made of the flexible planar material with a second top surface and a second bottom surface, the second top surface disposed in a second concave shape about the cradle, wherein the first and second cushions are not in contact with each other.

3. The shoe according to claim 2, wherein the shoe further comprises:

a third cushion configured to being attached to the directional cradle and the rear lower midsole, the third cushion being made of the flexible planar material with a third top surface and a third bottom surface, the third top surface disposed in a third concave shape about the cradle, wherein the first, second, and third cushions are not in contact with each other.

4. The shoe according to claim 3, wherein the first cushion is disposed under the user's heel.

5. A shoe having an upper and a lower, the lower comprising:

a primary midsole, configured to have a top surface and a bottom surface, the top surface to contact a set of five toes of the foot, the top surface having a periphery that curves up around a bottom of a heel of the foot;

a directional cradle configured to being attached to the primary midsole, the cradle having a cradle top surface and a cradle bottom surface, the cradle top surface having a concave shape curving up around the bottom of a foot;

a first cushion configured to being attached to the directional cradle, the first cushion being made of a flexible planar material, the first cushion having a first bottom surface opposite a first top surface and a first lateral surface about the periphery of the first cushion, the first lateral surface connecting the first top surface to the first bottom surface, the first lateral surface is not in contact with any other shoe component during use;

a rear lower midsole configured to being attached to the first cushion, the rear lower midsole having a bottom surface that is substantially flat and a top surface that is angled relative to the bottom surface; and an outsole configured to being attached to the bottom surface of the rear lower midsole, the directional cradle, and the primary midsole.

6. The shoe according to claim 5, wherein the shoe further comprises:

a second cushion configured to being attached to the directional cradle and the rear lower midsole, the second cushion being made of the flexible planar material, the second cushion having a second bottom surface opposite a second top surface and a second lateral surface about the periphery of the second cushion, the second lateral surface connecting the second top surface to the second bottom surface, and the second lateral surface is not in contact with any other shoe component during use.

7. The shoe according to claim 6, wherein the shoe further comprises:

a third cushion configured to being attached to the directional cradle and the rear lower midsole, the third cushion being made of the flexible planar material, the third cushion having a third bottom surface opposite a third top surface and a third lateral surface about the periphery of the third cushion, the third lateral surface connecting the third top surface to the third bottom surface, the third lateral surface is not in contact with any other shoe component during use.

8. The shoe according to claim 7, wherein the first cushion is disposed under the user's heel.

9. A shoe having an upper and a lower, the lower comprising:

a primary midsole, configured to have a top surface and a bottom surface, the top surface to contact a set of five toes of the foot, the top surface having a periphery that curves up around a bottom of a heel of the foot, the primary midsole configured to have a first support location for a calcaneous bone;

a directional cradle configured to being attached to the primary midsole, the cradle curving up around the bottom of a foot;

a first cushion configured to being attached to the directional cradle;

a rear lower midsole configured to being attached to the first cushion, the rear lower midsole having a bottom surface that is substantially flat and a top surface that is angled relative to the bottom surface; and an outsole configured to being attached to the bottom surface of the rear lower midsole, the directional cradle, and the primary midsole;

wherein the first cushion being disposed between the first support location and a strike point on the outsole.

10. The shoe according to claim 9, wherein:

the top surface of the primary midsole configured to have a second support location for a namcular bone;

a second cushion configured to being attached to the directional cradle and the rear lower midsole, the second cushion being disposed between the second support location and a second location of the outsole nearest the second support location; and the cradle having a set of openings configured to interface with a corresponding set of raised surfaces on the primary midsole.

11. The shoe according to claim 10, wherein:

the top surface of the primary midsole having a third support location for a cuboid bone;

the cradle including a first angled edge and a second angled edge, the angled edges configured to interface with a first complementary edge and second complementary edge on the primary midsole; and a third cushion configured to being attached to the cradle and the rear lower midsole, the third cushion being disposed between the third support location and a third location of the outsole nearest the third support location.

12. The shoe according to claim 11, wherein the first cushion being made of a flexible planar material with a first top surface and a first bottom surface, the first cushion disposed substantially according to a first geometric line that is tilted down from horizontal, the first geometric line is within a first geometric vertical plane which intersects both the first support location and the strike point;

the second cushion being made of the flexible planar material with a second top surface and a second bottom surface, the second cushion disposed substantially according to a second geometric line that is tilted down from horizontal, the second geometric line is within a second geometric vertical plane which intersects the second support location, the second geometric vertical plane also is also orthogonal to the perimeter of the primary midsole; and the third cushion being made of the flexible planar material with a third top surface and a third bottom surface, the third cushion disposed substantially according to a third geometric line that is tilted down from horizontal, the third geometric line is within a third geometric vertical plane which intersects the third support location, the third geometric vertical plane also is also orthogonal to the perimeter of the primary midsole.

13. The shoe according to claim 12, wherein the rear lower midsole is attached to both the first cushion and third cushion;

an inner rear lower midsole is attached to the second cushion; and a second outsole is attached to a bottom of the inner rear lower midsole.

14. The shoe according to claim 13, wherein the first geometric line is tilting down an angle within a range of 34 and 40 degrees;

the second geometric line is tilting down an angle within a range of 25 and 31 degrees; and the third geometric line is tilting down an angle within a range of 20 and 26 degrees.

15. The shoe according to claim 14, wherein the first cushion is made of polyurethane gel;

the second cushion is made of polyurethane gel; and the third cushion is made of polyurethane gel.

16. The shoe according to claim 12, wherein the first, second, and third cushions do not directly contact each other; and the cushions may expand at their periphery where they are not in contact with either the cradle or the rear lower midsole.

17. The shoe according to claim 16, wherein a portion of the bottom surface of the primary midsole protrudes through the cradle at a centerline of the shoe;

the first cushion is unattached to the portion of the bottom surface of the primary midsole;

the second cushion is unattached to the portion of the bottom surface of the primary midsole;

the third cushion is unattached to the portion of the bottom surface of the primary midsole;

the cradle is unattached to the portion of the bottom surface of the primary midsole, the rear lower midsole is unattached to the portion of the bottom surface of the primary midsole; and the outsole is unattached to the portion of the bottom surface of the primary midsole.

18. The shoe according to claim 16, wherein the outsole includes a rear outsole, an outer lateral outsole, an inner lateral outsole, a medial outsole, and a forefoot outsole;

the rear outsole attached to the lower rear midsole and the cradle;

the medial outsole attached to the primary midsole; and a forefoot outsole attached to the primary midsole.

19. The shoe according to claim 16, wherein the first geometric line is tilting down an angle within a range of 16 and 22 degrees;

the second geometric line is tilting down an angle within a range of 14 and 20 degrees; and the third geometric line is tilting down an angle within a range of 18 and 25 degrees.

20. The shoe according to claim 16, wherein the first cushion is made of polyurethane gel;

the second cushion is made of polyurethane gel; and the third cushion is made of polyurethane gel.

21. The shoe according to claim 16, wherein:

the primary midsole is attached to the cradle via a first epoxy glue amount;

the cradle is attached to the first cushion via a second epoxy glue amount;

the first cushion is attached to the rear lower midsole via a third epoxy glue amount; and the outsole is attached to the rear lower midsole via a fourth epoxy glue amount.

22. The shoe according to claim 10, wherein the top surface of the primary midsole configured to have a second support location for a namcular bone;

the top surface of the primary midsole having a third support location for a cuboid bone;

the first cushion also being disposed between the second support location and a second location of the outsole nearest the second support location;

a second cushion configured to being attached to the directional cradle and the rear lower midsole, the second cushion being disposed between the third support location and a third location of the outsole nearest the third support location; and the cradle having a set of openings configured to interface with a corresponding set of raised surfaces on the primary midsole.

23. The shoe according to claim 22, wherein the first cushion being made of a flexible planar material with a first top surface and a first bottom surface, the first cushion disposed substantially according to a first geometric line that is tilted down from horizontal, the first geometric line is within a first geometric vertical plane which intersects both the first support location and the strike point area;

the first cushion also disposed substantially according to a second geometric line that is tilted down from horizontal, the second geometric line is within a second geometric vertical plane which intersects the second support location, the second geometric vertical plane also is also orthogonal to the perimeter of the primary midsole; and the second cushion being made of the flexible planar material with a second top surface and a second bottom surface, the second cushion disposed substantially according to a third geometric line that is tilted down from horizontal, the third geometric line is within a third geometric vertical plane which intersects the third support location, the third geometric vertical plane also is also orthogonal to the perimeter of the primary midsole;

the first geometric line is tilting down an angle within a range of 15 and 21 degrees;

the second geometric line is tilting down an angle within a range of 20 and 26 degrees; and the third geometric line is tilting down an angle within a range of 15 and 21 degrees.

24. The shoe according to claim 9, wherein the top surface of the primary midsole configured to have a second support location for a namcular bone;

the top surface of the primary midsole having a third support location for a cuboid bone;

the first cushion also being disposed between the second support location and a second location of the outsole nearest the second support location;

the first cushion also being disposed between the third support location and a third location of the outsole nearest the third support location; and the cradle having a set of openings configured to interface with a corresponding set of raised surfaces on the primary midsole.

25. The shoe according to claim 24, wherein the first cushion having a first top surface and a first bottom surface, the first cushion disposed substantially according to a first geometric line that is tilted down from horizontal, the first geometric line is within a first geometric vertical plane which intersects both the first support location and the strike point area;

the first cushion also disposed substantially according to a second geometric line that is tilted down from horizontal, the second geometric line is within a second geometric vertical plane which intersects the second support location, the second geometric vertical plane also is also orthogonal to the perimeter of the primary midsole; and the first cushion also disposed substantially according to a third geometric line that is tilted down from horizontal, the third geometric line is within a third geometric vertical plane which intersects the third support location, the third geometric vertical plane also is also orthogonal to the perimeter of the primary midsole;

the first geometric line tilts down an angle within a range of 14 and 20 degrees;

the second geometric line tilts down an angle within a range of 10 and 17 degrees; and the third geometric line tilts down an angle within a range of 3 and 10 degrees.

* * * * *